US010156412B1

(12) United States Patent
Price

(10) Patent No.: US 10,156,412 B1
(45) Date of Patent: Dec. 18, 2018

(54) MUZZLE BRAKE WITH PROPELLING NOZZLE FOR RECOIL CONTROL

(71) Applicant: Donald H. Price, Port Townsend, WA (US)

(72) Inventor: Donald H. Price, Port Townsend, WA (US)

( * ) Notice: Subject to any disclaimer, the term of this patent is extended or adjusted under 35 U.S.C. 154(b) by 0 days.

(21) Appl. No.: 15/658,233

(22) Filed: Jul. 24, 2017

Related U.S. Application Data

(60) Provisional application No. 62/366,505, filed on Jul. 25, 2016.

(51) Int. Cl.
*F41A 21/36* (2006.01)
*F41C 3/00* (2006.01)

(52) U.S. Cl.
CPC ..... *F41A 21/36* (2013.01); *F41C 3/00* (2013.01)

(58) Field of Classification Search
CPC ..... F41A 21/36
USPC ..... 89/14.3; 42/1.06
See application file for complete search history.

(56) References Cited

U.S. PATENT DOCUMENTS 1,605,393 A * 11/1926 Cutts, Jr. ..... F41A 21/36 89/14.3
2,191,484 A * 2/1940 Hughes ..... F41A 21/38 89/14.3
2,953,972 A * 9/1960 Sorensen ..... F41A 21/325 261/114.1
4,307,652 A * 12/1981 Witt ..... F41A 21/36 89/14.3
4,322,999 A * 4/1982 Aston ..... F41A 21/36 89/14.3
4,429,614 A * 2/1984 Tocco ..... F41A 21/36 89/14.3
5,698,810 A * 12/1997 Rose ..... F41A 21/32 42/97
7,032,339 B1 * 4/2006 Bounds ..... F41A 21/36 42/1.06
9,689,636 B2 * 6/2017 Randall ..... F41A 21/36

* cited by examiner

*Primary Examiner* — Reginald S Tillman, Jr.
(74) *Attorney, Agent, or Firm* — Heisler & Associates

(57) ABSTRACT

The muzzle brake attaches to a distal end of the barrel of a firearm, typically a handgun, either built into the firearm or as an accessory attachable to the firearm. The muzzle brake includes a propelling nozzle in the form of a central chamber aligned with proximal and distal openings aligned with a barrel of the firearm. This propelling nozzle extends upward, generally expanding in cross-section, to a rim where it opens above the firearm near a distal end of the barrel. The shape of the propelling nozzle (or series of nozzles) is preferably selected to optimize downward reactive force when expanding gases discharged from firearm discharge expand upward out of the propelling nozzle. A downward reactive force is thus created which counteracts recoil of the firearm.

15 Claims, 22 Drawing Sheets

3
210
230
240
220

240
220
230
210

3
A
220
210
C
230
240

3
210'

3
220
210'
230
240

A
C

210

MUZZLE BRAKE WITH PROPELLING NOZZLE FOR RECOIL CONTROL

CROSS-REFERENCE TO RELATED APPLICATIONS

This application claims benefit under Title 35, United States Code § 119(e) of U.S. Provisional Application No. 62/366,505 filed on Jul. 25, 2016.

FIELD OF THE INVENTION

The following invention relates to recoil control devices for firearms. More particularly, this invention relates to devices which attach to or are built into a distal end of a barrel of a firearm, or its frame, and which use a propelling nozzle to maximize the velocity redirection of expanding gases from a firearm discharge to compensate for firearm recoil.

BACKGROUND OF THE INVENTION

Firearms accommodate firing a bullet (or other projectile) from a cartridge filled with a propellant charge, inserted into a "chamber" of the firearm which, when ignited, creates a high pressure, high temperature gas. This high pressure gas is contained by the cartridge and the chamber of the firearm, so the path of least resistance is to push the bullet into a barrel of the firearm, located in front of the chamber. The sides of the bullet are in direct contact with the wall of the barrel, where there is also typically "rifling," which causes the bullet to spin, thus increasing accuracy. The bullet is forced under this tremendous pressure of the expanding combustion gases behind and it eventually exits at the muzzle, at the distal end of the barrel where the barrel ends. As the bullet exits the muzzle and begins to travel freely through the air, this high pressure, high temperature gas exits behind it and immediately begins to expand in all directions. This burst of expanding gas essentially functions like a rocket and pushes the gun directly back by Newtons Third Law of Motion. This force is resisted by the users hands and arms and thus the firearm "kicks" up and back. In pistols and revolvers, this backward and upward movement is commonly called "muzzle flip" or "muzzle rise."

This recoil is highly undesirable as it throws off the aim of the user. As this recoil action eliminates the users "sight picture" and the alignment of the firearm with the target, the user must take time after each shot to regain control of the firearm and then carefully re-align the sights. As stated above, it is this destruction of the sight picture and the critical delay in reacquiring it before firing again, that endangers the user, any innocents being protected and possible innocent bystanders. This delay can also mean the difference between winning or losing in professional shooting competitions.

Handheld firearms, both semiautomatic pistols and revolvers, are used for competitive sports, personal defense and by law enforcement and the military. In all of these uses, being able to accurately, rapidly and repeatedly direct a projectile to a target is paramount. Especially with handguns, which shoot a less powerful bullet, failure to achieve rapid fire accuracy can be a great danger to the user and any innocents who the user is attempting to protect. In addition, innocent bystanders may be in danger from stray shots occurring due to the recoil effect throwing off the aim of the user.

Accuracy is achieved by properly aligning sighting devices of different sorts that sit atop the firearm. When a firearm is discharged, an explosive blast of expanding gases exits the front of the barrel, causing a "jet" effect that thrusts the firearm backward toward the user holding it. This force, blocked in its backward momentum by the user's grasp, causes the muzzle end of the firearm to violently rotate upwards and backwards, in the "muzzle flip" or "muzzle rise" phenomena. This action eliminates the users "sight picture" and the alignment of the firearm with the target. Thus the user must take time after each shot to regain control of the firearm and then carefully re-align the sights. As stated above, it is this critical delay that endangers the user, any innocents being protected and possible innocent bystanders.

That there is a paramount need for devices to control this "recoil" effect has been widely accepted. For many decades, such devices, usually called "muzzle brakes" or "compensators" have been manufactured in attempts to control the recoil effect. The current devices available are less efficient than desired and tend to be bulky and expensive, as well as potentially interfering with the function of the gun. For these and perhaps other reasons, such muzzle brake devices are only seen on a small fraction of pistols and revolvers available commercially and are especially rare or non-existent on police or military weapons. Although "muzzle brakes" are seen more commonly on rifles, the prior art is similarly less efficient than desired.

In the case of semiautomatic pistols, installing a typical prior art "muzzle brake" or "compensator" requires the user to first purchase a special, extended, threaded barrel. The user must then purchase the muzzle brake separately, which screws on to the end of this special barrel. Great care must be taken to screw the brake on to the proper depth and position and it must be secured properly or there is a risk it will come loose during repeated firing, possibly endangering the user and other bystanders. Many consumers will pay additional fees to a professional to assure proper installation.

These prior art muzzle brakes or compensators consist of a square or round piece of metal with multiple and various arrays of what are called "ports," "baffle plates," "slots" or "fins." The common belief is that these elements "strip off" the expanding gases from around the bullet and "redirect" them upwards and to the sides and therefore lessen the "felt recoil." It is also believed these baffle plates, when struck by the expanding gases, can "push" the gun forward to help counteract the backward effect of the "recoil." Some of these devices are two or three inches long, with multiple "ports" and "baffles." Particularly when considering handguns, adding almost 25% or more onto the length of the gun and adding on considerable weight and length makes such a device less practical, especially for legal concealed carry or for professionals in law enforcement and the military.

Scientific research has shown that these prior art devices achieve at most about a 30% reduction in recoil forces. This is primarily because the prior art muzzle brakes do not use true propelling nozzles that are scientifically designed to facilitate and maximize the conversion of heat energy into velocity. True propelling nozzles have a "throat" where hot compressed gas is introduced into the nozzle and a single, smooth, curved nozzle with diverging and enlarging sides facilitate the hot compressed gas to increase in velocity. The propelling nozzle then smoothly directs this hyper velocity gas in a specific direction to create thrust via Newton's Third Law of Motion. In contrast, the baffle plates, fins, square bottomed slots, ports, etc., actually interfere with this process. These obstructions create, in the words of rocket science, "friction, flow disturbances and shock losses"

which interfere with the expansion and increase in velocity of the gases. However, it is exactly the increasing velocity of the combustion gases that create the "thrust" available to beneficially counteract recoil. What is needed to properly utilize the full potential of the high pressure, high temperature gases is a "propelling nozzle", as is used for rockets, but specially adapted for use on firearms. Such a propelling nozzle can create useable "thrust" through a specific shape and structure that facilitates the conversion of heat energy into velocity and thus into maximum thrust. It is this velocity (and associated mass of the gas) which transfers momentum to the firearm and can thus create thrust as the now high speed gas exits the end of the propelling nozzle. So in prior art devices, these obstructions slow down the expansion of the combustion gases, thus actually decreasing the thrust needed to effectively counter recoil.

Many prior art devices have "ports" or holes directing the expanding gases to the sides. This wastes the energy available in the gases that could be used to properly push the muzzle down. Others have square bottomed or flat bottomed holes or slots that set up a "shock wave" pattern within the device, rather than smoothly redirecting the power of the gases to their proper use of controlling recoil. In the true propelling nozzles of jets or rockets, designs do not have structures such as baffle plates, ports or other holes, but rather have a smooth, curved expanding diameter nozzle that allows the expanding gas to reach maximum velocity. The high velocity gas is then directed in the direction needed to push the rocket or aircraft in the desired direction. Similarly, if a hand gun recoils upwards, then all the gas should be smoothly redirected into a large jet of gas which flows upwards to push the muzzle end down.

Another type of prior art muzzle brake is made by directly cutting small holes or slits into the barrel of the gun itself, directly into and through the "rifling." The idea is that this bleeds off high pressure gas pushing the bullet down the barrel and redirects it upwards. Although this method does not add bulk to the gun, it is relatively inefficient due to the size of the ports or slots being too small. Also, such holes do not gradually enlarge like an efficient nozzle. Rather, by bleeding off gas before the bullet has actually exited the barrel, such designs can actually slow down the velocity of the bullet which makes the firearm less effective and useful overall.

Most state of the art devices, due to their inefficiency and method of attachment, create additional bulk and weight on the front of the gun. This makes such devices less practical to use for legal concealed carry and undesirably heavy for prolonged use such as in law enforcement or the military. The bulk and weight actually can also potentially interfere with the functioning of the gun and can cause it to jam and cease functioning. Also, prior art devices, while providing limited efficiency and greater bulk and weight, can cost up to or over half of the entire original cost of the firearm, in the case of a typical handgun, when the cost of the brake itself, the special extended barrel and professional installation are added up.

For the above reasons, prior art muzzle brakes or compensators have not seen broad commercial success and have not been seen as any type of standard for handguns. Other than limited use in high end, specialty competition shooting matches, such brakes are seldom used, and rarely if ever on the semiautomatic handguns used by law enforcement or the military.

In contrast, the invention described herein below, particularly for semiautomatic pistols and revolvers, is uniquely effective, achieving measured reductions of recoil of up to 70% and have in some instances been able to achieve 100% reduction in "muzzle flip" or "muzzle rise" if properly tuned. By being machined or formed directly into the barrel of the firearm during manufacturing (in one embodiment), it creates no additional weight or bulk and only a slight increase in length. Extra length is the least intrusive of size issues when considering legal concealed carry or carry by law enforcement or military users. The expense of adding in this feature during the modern CNC machining and manufacturing process is very minimal. Alternatively, consumers who already own firearms could simply buy a replacement slide which includes this feature. A number of companies already offer "after market" slides (without any such brakes built in) which cost considerably less than the purchase of a separate barrel and screw on muzzle brake, of the type currently available.

SUMMARY OF THE INVENTION

To reach maximum efficiency, a true propelling nozzle, designed specifically for firearms, is provided by this invention. The propellant charge of a firearm can be considered analogous to a rocket with fuel that burns or fires for only a fraction of a second as each cartridge is ignited. An essential part of a successful rocket design is its nozzle.

A rocket engine nozzle is a propelling nozzle used in a rocket engine to expand and accelerate the combustion gases produced by burning propellants so the exhaust gases exit the nozzle at hypersonic velocities. A properly configured rocket nozzle converts heat energy into velocity and then through Newton's Third Law of Motion, this hypersonic velocity produces "thrust" or momentum in the opposite direction.

Prior art "muzzle brakes" are not true "propelling nozzles" adapted to firearms. They typically feature square sided, flat bottomed "baffle plates," "ports," "holes," "slots," "fins" or similar elements, and may derive some benefit from the "thrust" of redirected gases, but the benefit is more by accident than design and does not fully maximize the potential inherent in the combustion gases through the design and use of a true propelling nozzle. In fact, the baffle plates, ports, slits, slots and other geometry that "redirects" expanding gases actually interfere with exploiting these propellant gases as they create what are described in rocket science as "friction, flow disturbances and shock losses" that prevent the expanding gases from properly expanding and reaching maximum velocity and thus creating maximum "thrust" to counteract recoil. Attempting to "redirect" gases with "baffle plates" or other prior art structures is an inefficient system, different and distinct from a true propelling nozzle, whose central effect is on smoothly increasing the velocity of the compressed gases through a smooth, curved, gradually expanding diameter nozzle.

Though some very few prior art may discuss the concept of a rocket nozzles and expansion chambers to increase the velocity of the combustion gases, they do not feature or teach a true nozzle shape, with a smaller starting area that gradually and smoothly expands, or that opens directly into the atmosphere to create thrust in the direction needed to directly counteract recoil forces. Nor are many of these designed for use in handguns, such as semiautomatic pistols or revolvers.

In a conventional rocket, the burning propellant creates a super heated, compressed gas, which then enters one end of the propelling nozzle, a narrower area called a "throat." The cross sectional area of the nozzle is carefully configured to allow the gas to smoothly expand and cool and thus greatly increases its velocity. The typical propelling nozzle is smaller where the gas enters and gradually and smoothly expands in cross sectional area for a given length to allow for proper expansion of the gas, converting heat into velocity and smoothly aiming the expanded, high velocity gas in the direction opposite to the recoil effect. In a true propelling nozzle, the area where the super heated and compressed gas enters, often called the "throat," is smaller in cross sectional area and the nozzle then gradually enlarges, with curved or substantially curved surfaces, which diverge toward the exit.

Similar to a rocket engine, a firearm operates by creating super heated, compressed gas which propels a bullet or projectile down a barrel and then out towards a target. Like a rocket, this gas suddenly expands when it exits the muzzle of the firearm, creating "thrust" for a fraction of a second which pushes the firearm suddenly and forcefully back toward the user.

Designing true propelling nozzles for firearms must take into account the different gas pressure and volumes created in each type. Semiautomatic pistols and revolvers, or long guns like rifles or shotguns, each require specific adaptations. Each may require a different size or shape, with the nozzle "aimed" in the correct direction to counter act the normal recoil forces.

For most semiautomatic pistol or revolvers, with their lower gas pressure and volume, my research has shown that a true propelling nozzle of the highest efficiency is a single, large, open topped cavity, smaller at the bottom and larger at the top. This propelling nozzle begins at the point where the bullet leaves the muzzle end of the barrel and begins to travel freely through the air. The bullet travels freely in a horizontal direction through the base of the nozzle, making no contact with the sides. The compressed combustion gases enter the nozzle immediately behind the bullet. Within the nozzle, there are no sharp corners or obstructions to slow down the acceleration of the expanding gas. In rifles or other long guns, with higher pressure and volume of propellent gases, there may typically be a number of smaller nozzles, not only on the top but to the side as well. The shape of the nozzle or nozzles could be conical, an upside down bell shape, or hemispherical at the bottom, with diverging sides. Towards the exit hole of the nozzle, there may sometimes be an area of non diverging or straight sides. In this case, in a nozzle with a hemispherical bottom, this may create a "U shape" when viewed in an axial profile. In a semiautomatic pistol or revolver, the single, large, unobstructed nozzle, starting at its bottom or throat, would be approximately at least as wide as the bullet diameter and becoming larger, perhaps several times that diameter at the exit area of the gases. In higher pressure long guns, the propelling nozzle or nozzles may start out closer to the same size as the bullet itself or much smaller.

A "propelling nozzle" uniquely adapted to counter the recoil of firearms beneficially meets a number of goals. First it redirects the gases in a direction to counter the recoil typical of that firearm. Semiautomatic pistols and revolvers typically "flip" that is, the firearm rotates backward in the user's grasp, with the muzzle end flipping up and back toward the user. So a propelling nozzle for a semiautomatic pistol or revolver will redirect the gases directly upwards to create "thrust" that will push the muzzle end of the firearm in a downward direction while at the same time increasing the velocity of the combustion gases.

Unique to a firearm, specifically in a semiautomatic pistol or revolver, the propellant gases do not enter in a linear, straight line into and through the nozzle. The compressed propellent gases exit the metal barrel, then entering the bottom of the nozzle, and travel horizontally across its bottom, expanding as it does so. Directly opposite the muzzle is an exit hole for the bullet or projectile to exit. These super hot, compressed gases, now free of their compression by the metal barrel, immediately begin to violently expand. Here a proper firearm nozzle smoothly channels this expanding gas into an upwards direction, following along properly curved or otherwise divergent surfaces without any obstructions.

Rather than allowing the compressed gas to expand in all directions as normally happens when it leaves the muzzle, the gas is blocked by the sides and bottom of the nozzle. The smooth, mostly curved, unobstructed, open topped, slowly enlarging shape of the nozzle, as a rocket nozzle, facilitates the increasing speed of the expanding gas until it exits the nozzle at maximum velocity, now traveling in a directly upwards direction. As it exits at super sonic velocity in an upwards direction, it creates "thrust" in the opposite downward direction, counter acting the muzzle rise and thus the muzzle of the firearm is able to stay in an almost neutral position and staying "on target." Due to the effective and smooth redirection of gases, there is also much less backward thrust as well. The user, rather than having the muzzle of their firearm violently flip up and backwards, may instead experience only a mild, directly backward movement that is easily controllable. The firearm "stays on target;" the muzzle and sighting elements may need only slight readjustment, if any, for the next properly aimed shot.

Another unique feature of this propelling nozzle designed specifically for a firearm, is that the amount of thrust can be controlled by the horizontal length of the nozzle, if more thrust is needed. In a conventional rocket nozzle, the thrust is controlled by how long the "burn time" of the rocket fuel is, how many seconds or minutes the fuel burns to create a certain amount of thrust to accomplish a certain goal. In a firearm, different calibers may contain widely differing amounts of propellant and thus create different volumes and pressures of gas and other combustion products, which create different amounts of "muzzle flip."

So to "fine tune" the amount of directional thrust that is needed to eliminate the muzzle flip or recoil of a given caliber, more thrust can be generated for a longer period of time by horizontally lengthening the propelling nozzle. In a semiautomatic pistol or revolver, the side to side dimensions of the propelling nozzle is limited by the width of the slide of a semiautomatic or to some degree the width of the metal surrounding the barrel of a revolver. It could be made wider, but this would create complications in manufacturing and change the width of the firearm which would have other undesirable effects for the user, such as increased bulk, which will make fitting the firearm into a holster more difficult. But by simply lengthening the nozzle in a horizontal direction away from the muzzle end of the firearm, the amount of thrust can be carefully tuned to eliminate all or almost all, upward "muzzle flip." So a propelling nozzle can be tuned for specific calibers by the length, width and depth of the propelling nozzle expansion chamber.

As the compressed gas exits the muzzle of the barrel, it is blocked by the curved sides and bottom of the propelling nozzle. It can now only expand up but can still also expand in a forward direction, away from the muzzle and user. Because there must be an opening in the other side of the bottom of the nozzle for the bullet or projectile to exit, the gas also expands in a forward direction toward this area of lower pressure. The longer the propelling nozzle is, the more gas will expand and exit in an upwards direction before it reaches the exit hole for the bullet. This increases the "burn time" or length of time that downward thrust is created.

Another unique feature of this propelling nozzle that is integral or built in to the "slide" of a semiautomatic pistol, is that the top of the exit hole at the front of the nozzle area, might be cut away to allow for the barrel of the pistol to tilt upwards during the recoil cycle, as is typical of semiautomatic pistols. But due to the fact that the propellent gases expand and exert thrust continuously as they travel across and through the base of the nozzle, from the muzzle to the bullet exit hole in a horizontal direction, this "open ended" nozzle arrangement does not lose any appreciable thrust. If more is needed due to this opening, the nozzle is simply lengthened further.

So the preferred embodiment for this propelling nozzle designed for a semiautomatic pistol or revolver has a single, large, unobstructed, open topped hole which has both a proximal entrance hole and a distal exit hole for the projectile to travel horizontally through its base. The propelling nozzle is smaller at its base and gradually becomes larger in an upward direction. After diverging for a certain distance, the walls of the nozzle may then become parallel or substantially parallel. Or they may follow a more steadily diverging curve or line. The propellant gases enter the base of the nozzle at the muzzle end of the barrel, traveling in a horizontal direction. The sides of the propelling nozzle for firearms are curved or substantially curved, or otherwise diverging, while gradually widening toward the exit of the large and unobstructed nozzle end. Such a propelling nozzle may be in the shape of a cone, bell or hemispherical shape, with the smaller cross sectional area at the "bottom" of the nozzle, opposite from the desired direction of thrust. So the shape of the nozzle allow the propellent gases to rapidly expand while at the same time smoothly channeling them in the proper direction, without obstructions that would interfere or slow down their expansion. This allows them to achieve maximum velocity as they leave the exit opening and create maximum thrust.

A propelling nozzle for long guns, firearms such as rifles or shotguns, may require their own unique adaptations for maximum recoil reduction. The pressure of the ignited and burning propellant gases in long guns is typically much greater than that of firearms like semiautomatic pistols or revolvers. Because of this much greater pressure, the overall size of the expansion area of the propelling nozzle can or should be much smaller, because it is possible to push the firearm too far in the opposite direction of recoil. In other words, when a rifle is fired, the muzzle end of the firearm will typically move sharply up and to the right. A propelling nozzle of improper size may actually move the firearm sharply down and to the left, which would have the same undesired consequences of disturbing the alignment of the sighting elements and the alignment of the firearm with its target. A properly tuned propelling nozzle for firearms would allow the firearm to stay in as close alignment with the target as possible after firing.

For high pressure firearms, the propelling nozzles may be much smaller in size and cross sectional area. The nozzles could even be entirely straight sided holes, with no divergence or only slight divergence of their sides. High pressure propelling nozzles may have multiple small nozzles to minimize the blast and noise to the user but still achieve the same effect as a single larger propelling nozzle.

Another characteristic of high pressure long guns is that the muzzle end of rifles or other long guns rise up and back toward the user, as handguns do, but also twist to the right, in the case of the typical right handed shooter. Some of this twist is due to the effect of the projectile turning in the "rifling" of the barrel. Rifling consists of small, very shallow grooves cut into the barrel of firearms to make a bullet or projectile spin rapidly after it leaves the barrel, therefore greatly increasing its stability in flight and therefore accuracy as it travels to a target.

In order to counter act this sideward twist or movement, a propelling nozzle for long guns may require multiple nozzles that not only point upward, to push the barrel down, but also nozzles that are aimed or pointed to the side, to create thrust in the opposite direction of typical recoil movement.

So for example, an adaptation for a rifle may have a propelling nozzle or nozzles in a row on the top of the brake and then also a nozzle or row of nozzles that point to the side, by varying degrees. There could be a nozzle or row of nozzles pointing directly up from the center of the brake area, then a nozzle or row of nozzles pointing to the right at 45 degrees from the top center and then another row at 90 degrees from the top center, or directly to the side, when the rifle is held in a normally upright position. These nozzles or row of nozzles may also be staggered down the length of the brake area. For example, the first nozzle or row of nozzles could be directly on top of brake area, with the first nozzle or nozzles directly in front of the muzzle, where the bullet leaves the rifling and is now traveling freely. Then the next nozzle or row of nozzles could start further down the brake area from the muzzle as well as pointing more to the side on a different angle. If single nozzles are used, this could be visualized as a "spiral" effect. With each nozzle following a spiral to the side and forward at the same time on the brake area.

A fully automatic firearm, as used by the military in certain tactical situations, is a firearm where, when the trigger is pulled back and is continued to be held back by the user, the firearm continues to fire by itself as long as the trigger is held back. This creates another situation that must be taken into account when tuning or adapting a propelling nozzle or nozzles for use in such a firearm. Fully automatic fire creates a situation analogous to a rocket whose fuel burns for a more prolonged time. Developing a propelling nozzle or nozzles for firearms of this type may require a different configuration for each different firearm type or model, in terms of the size, number, configuration and placement of the propelling nozzles in the brake area.

A semiautomatic handgun two main components; a lower part called a "frame," which can be made of metal or plastic, which has a grip area that allows it to be held in one hand; inside this hollow grip area is an area to insert a "magazine," which holds a number of cartridges. Cartridges consist of a brass or other metal "case," filled with explosive powder and a bullet that is seated at the top of the casing. A spring pushes the cartridges upward within the magazine, which is open on top. They are held in place by "feed lips."

On top of the "frame" is the "slide," manufactured of metal, which contains the striker and various other components and that when a cartridge is ignited, "slides" back on top of the frame, guided and held in place by interlocking rails on the frame and slide. This sliding action allows already fired cases to be extracted from the barrel and ejected out an opening on the side of the slide. The slide, then under the pressure of a spring held in place by a guide rod, is pushed back over the top of the magazine in the grip of the frame where it strips off a new, non ignited cartridge, pushes it forward and locks it into place in the "chamber" which is in the rear of a the barrel.

The under side and inside front of a typical semiautomatic slide has round hole where the barrel fits through, the barrel being made of heavy metal with a long hollow, tubular interior which ends in a chamber at one end, closer to the user and an opening at the far end, called the "muzzle" where the bullet will exit after it is forced down the hollow tube of the barrel. The barrel protrudes very slightly from the "slide." The inside of the barrel contains the "rifling," very shallow grooves cut into the metal that engage the bullet and cause it to spin rapidly after it leaves the muzzle, for increased accuracy.

After a cartridge is fired, the slide recoils backward and unlocks the barrel, which tilts upward as the slide travels rearward, toward the user. The hole through which the barrel protrudes allows the slide to recoil backward while the barrel and spring guide rod stay in position, with the barrel tilting upwards somewhat. Once the slide has traveled rearward far enough to eject the empty cartridge case, it stops and is then forced forward by the spring on the guide rod. Now traveling forward, away from the user on top of the frame, the slide now strips off a fresh cartridge from the top of the magazine and pushes it into the chamber of the barrel. The slide and barrel are then locked into place for this new cartridge to be ignited by the striker pin or hammer, initiated by a pull of the trigger by the user.

Normally, a "slide" of a semiautomatic pistol ends just after where the front sight is attached and where a hole in the front end of the slide allows the barrel to slightly protrude. To create this unique, built in or integral recoil control mechanism, an extension is machined, during the original manufacturing process, onto the front of the metal "slide" beyond where the front sight is located. Into this extension is machined the "propelling nozzle," a specially shaped cavity designed to allow the super heated combustion gases to enter at the bottom from a horizontal direction and rapidly expand upwards without obstruction, thereby increasing rapidly in velocity, which creates thrust as it exits the opening at the top of the slide extension.

This cavity is a single, large, open, unobstructed area which is smaller at its bottom and larger at its top. It can appear to be round with a hemispherical bottom, a cone shape with the large part of the cone facing upwards, an upside down bell shape or "stadium" shaped, with flat areas on the sides and front and back. It has no sharp corners.

The cavity which forms the propelling nozzle begins just underneath where the barrel normally protrudes from the end of the slide. It has a curved or substantially curved bottom whose sides gradually diverge as it goes upward. The sides can follow a curve, as in an upside down bell shape, be straighter, as in a cone with the larger end facing up. The bottom of the propelling nozzle could also be hemispherical, with sides that then become straight or almost straight, parallel or more parallel as they rise up to the exit and may form a "U" shape. In all variations there are no sharp corners, although in some embodiments there could be flat areas on the sides and/or front and back, with curved corners connecting them.

Different variations of an integral propelling nozzle could be easily machined by using a "ball end mill" of the appropriate size in a common CNC machining center. To create a propelling nozzle that is more hemispherical, or stadium shaped, a ball end mill can then drill into the metal to the correct depth and then if desired, moved back and forth, forward or backward, to create a certain size hole with rounded corners and bottom edges, or more of a "U" shape in the case of a hemispherically bottomed nozzle, when viewed axially. The back edge of this hole begins about where the muzzle end of the barrel protrudes slightly from the metal slide. The depth of the hole may be slightly deeper than the bottom edge of the barrel. This round bottomed hole has a circular hole cut in its forward edge to allow the bullet to exit. The top edge of this exit hole may also be cut out to allow room for the barrel of a semiautomatic handgun to tilt upwards during its firing cycle. In semiautomatic firearms, directly underneath and separate from this large spherical hole, is another smaller hole, drilled through the device, which is large enough to allow for the "guide rod" of a semiautomatic pistol to go through it during its firing/recoil cycle. This prevents any interference with the mechanical function of the gun.

To create a more conical or upside down "bell" shaped propelling nozzle, a ball end mill that fits into the smallest radius at the bottom of the nozzle geometry can be chosen and the shape can be made by running a multi-surface finish contour program. On revolvers, an extension of the metal that surrounds the barrel at the muzzle end can be machined into the firearm. This extension can be widened and extended to whatever degree is needed to provide room to create a properly sized and shaped "propelling nozzle" as described above to achieve the degree of recoil control desired. Revolvers have no "guide rod" so the extra hole or space as described above is not needed.

With this invention, a simple to manufacture, inexpensive, highly effective device to control recoil on firearms, particularly on semiautomatic pistols and revolvers, is provided. Borrowing from the science of rocket technology, a high velocity propelling nozzle, uniquely configured for use in firearms, is provided as an extension of the metal slide of a semi automatic pistol, or the shroud of metal surrounding the barrel of a revolver. In an alternative embodiment, such a propelling nozzle could be built in as part of the frame of a semiautomatic pistol, rather than the "slide," either machined as part of a metal frame or in the case of "polymer" or plastic framed pistols, a nozzle could be embedded into the plastic frame as a machined or stamped metal part during the manufacturing process or otherwise incorporated into the design of the firearm. The nozzle is upwardly extending and preferably expanding in cross-sectional area as it extends upwardly. This nozzle is located near a distal or muzzle end of the firearm.

In another embodiment of this built in muzzle brake, the extension component, as machined into a metal slide of a semiautomatic pistol or barrel of a revolver, could also be configured with any number, type or style of conventional "muzzle brake" prior art, such as ports, slots or baffle plates but combining it with the specially configured propelling nozzle of this invention as well. Thus, the propelling nozzle can be used above or in combination with prior art muzzle brake technology to enhance overall effectiveness.

In another embodiment of the specially configured propelling nozzle component, it could be attached to the semi-automatic pistol separately by a device that clamps onto the "picatinny rail," which is a part of typical semiautomatic pistols in common use today. This nozzle could also be attached or machined into an extension of the "frame of the pistol, rather than the "slide." Combining the propelling nozzle with the integral metal extension is the preferred embodiment due to its robust strength, minimal, streamlined profile and ease and cost of manufacture. If the nozzle is built into the frame of a semi-automatic pistol, it could be machined into two parts, so the forward part detaches to allow for removal of the barrel and slide for cleaning and maintenance.

Similarly, for rifles, shotguns or other long guns, this propelling nozzle could be integral to the barrel or could be a separate unit that is attached later, either by screwing, clamping or other methods. Due to the higher volume and gas pressure of most long guns, the propelling nozzle or nozzles may vary considerably from those used in pistols, in the size, shape, direction, number of nozzles or the configuration of multiple nozzles as needed to achieve maximum effective recoil control.

OBJECTS OF THE INVENTION

Accordingly, a primary object of the present invention is to provide a specially configured propelling nozzle incorporated directly into the slide of a semiautomatic pistol, its frame or other structure of a firearm itself, to create a significant and novel method to achieve recoil control which is more effective, streamlined and inexpensive than existing devices, to benefit competitive shooters, legally armed civilians, law enforcement and the military, and ultimately protect innocent lives.

Another object of the present invention is to provide compensation for recoil in a handgun or other firearm.

Another object of the present invention is to provide a firearm which avoids recoil or minimizes recoil.

Another object of the present invention is to provide a firearm which can remain aimed more precisely at a target immediately after firing of the firearm, such that further shots immediately after projectile discharge will have a greater tendency to strike close to the target.

Another object of the present invention is to provide a firearm which is more accurate in delivering a projectile to a particular intended target.

Another object of the present invention is to provide a method for minimizing recoil of a firearm.

Another object of the present invention is to provide an accessory for a firearm which is attachable to the firearm to minimize recoil experienced by the fire.

Other further objects of the present invention will become apparent from a careful reading of the included drawing figures, the claims and detailed description of the invention.

DESCRIPTION OF THE PREFERRED EMBODIMENT

Figure 1:
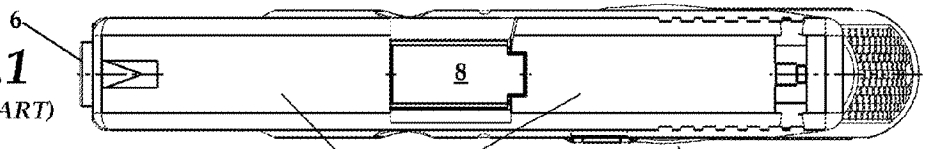
Fig.1 (PRIOR ART)
FIG. 1 is a top plan view of a typical prior art semiautomatic pistol without the invention included therein.

Referring to the drawings, wherein like reference numerals represent like parts throughout the various drawing figures, reference numeral 10 is directed to a muzzle brake (FIGS. 4-11) which can be built into a handgun or other firearm (such as a pistol 2), or attached to a muzzle end of a barrel 6 of the pistol 2 (or other firearm). The muzzle brake 10 focuses expanding projectile motion gases through a propelling nozzle 40 to at least partially counteract recoil of the firearm.

Figure 3:
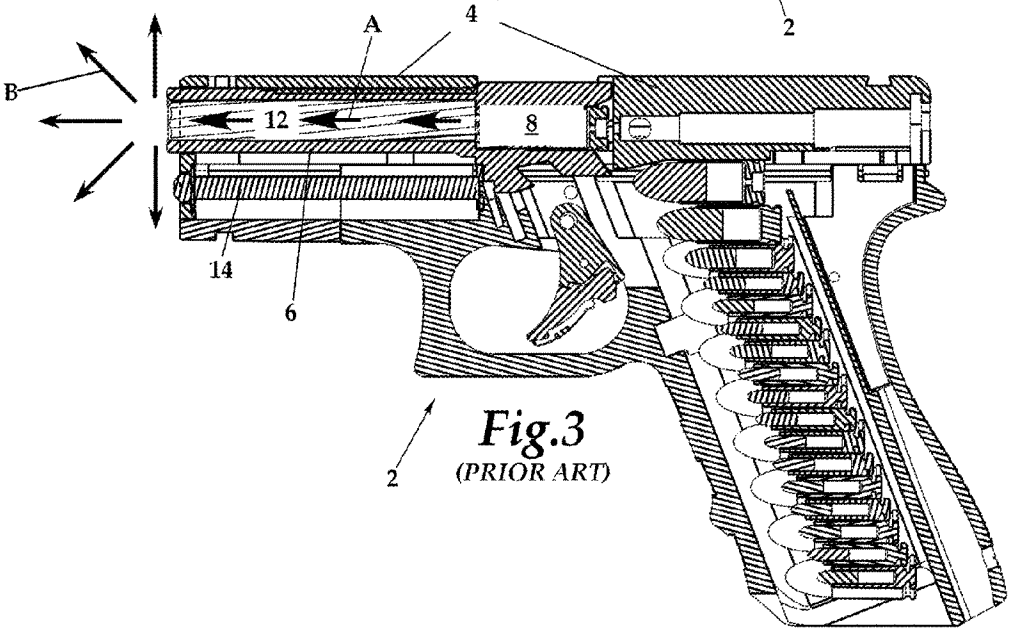
Fig.3 (PRIOR ART)
FIG. 3 is a full sectional side elevation view of that which is shown in FIG. 1.
Figure 2:
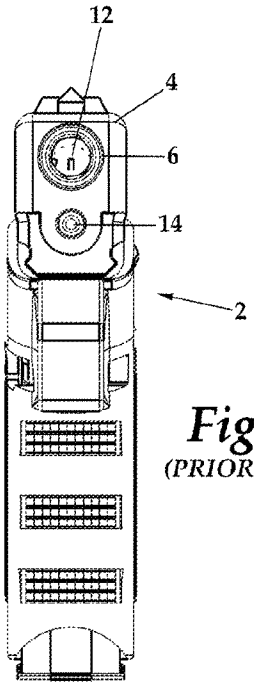
Fig.2 (PRIOR ART)
FIG. 2 is a front elevation view of that which is shown in FIG. 1.
Figure 5:
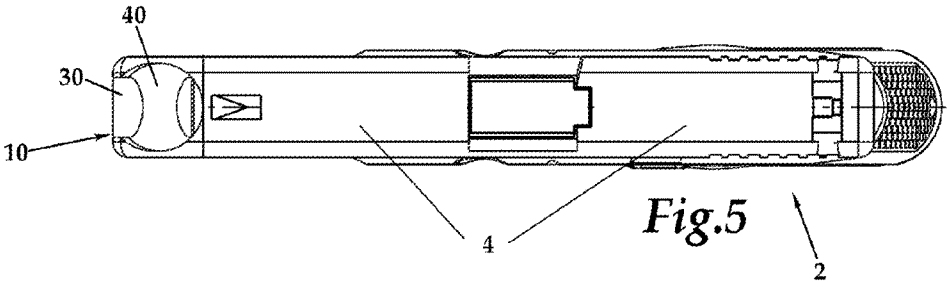
FIG. 5 is a top plan view of that which is shown in FIG. 4.
Figure 6:
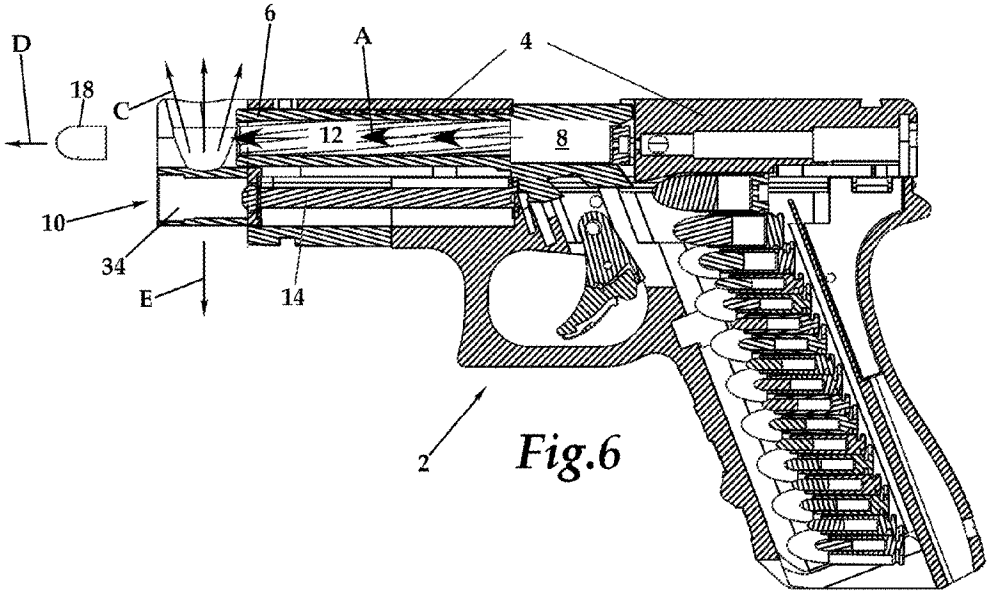
FIG. 6 is a full sectional side elevation view of that which is shown in FIG. 4, and illustrates how a generally hemispherical and somewhat parabolic propelling nozzle built into an extension of the slide allows the compressed and super heated gases to rapidly expand in an upward direction.
Figure 4:
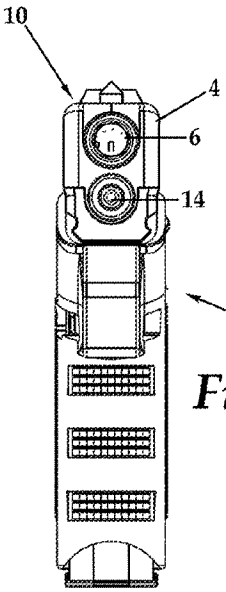
FIG. 4 is a front elevation view of a semiautomatic pistol including one embodiment of this invention integrated into a typical semiautomatic pistol.
Figure 8:
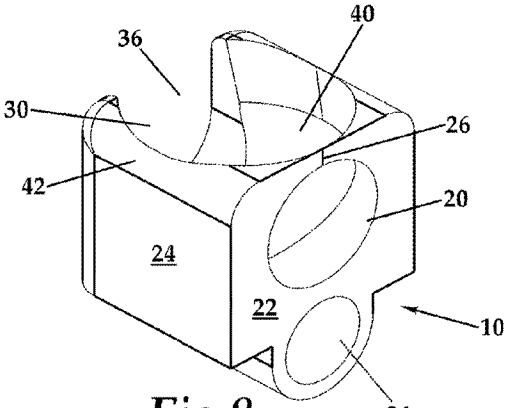
FIG. 8 is an isometric view of that which is shown in FIG. 7.
Figure 7:
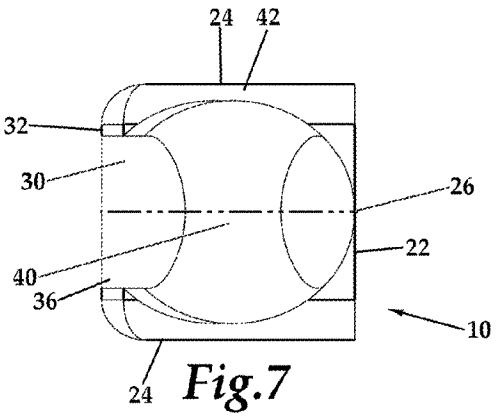
FIG. 7 is a top plan view of the hemispherical propelling nozzle of FIGS. 4-6 shown isolated from the firearm, for purposes of illustration.
Figure 11:
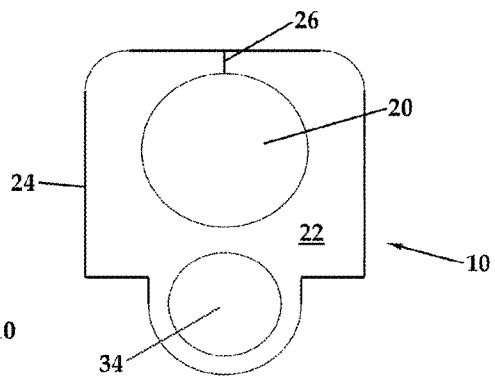
FIG. 11 is a rear elevation view of that which is shown in FIG. 7.

In essence, and with particular reference to FIGS. 4-11, basic details of this invention are described, according to a first and generally preferred embodiment. In this embodiment, the muzzle brake 10 is shown attached to a pistol 2 (FIGS. 1-3) of a generally semi-automatic variety having a slide 4 and barrel 6 extending forwardly relative to a chamber 8. A bore 12 of the pistol 2 is typically rifled to cause a bullet 16 discharged through the bore 12 to travel along a straighter trajectory (along arrow D of FIG. 6). The muzzle brake 10 is provided at a distal muzzle end of the bore 12 of the barrel 6. The muzzle brake 10 includes a proximal opening 20 and distal opening 30 on opposite ends thereof and aligned with a centerline which is aligned with a centerline of the bore 12 of the barrel 6. A central chamber is provided between the proximal opening 20 and the distal opening 30. A propelling nozzle 40 extends at least partially upwardly from this central chamber. Preferably, the propelling nozzle 40 has a diverging cross-section as it extends away from the central opening, so that the propelling nozzle 40 generally smoothly allows propulsive gases exiting the propelling nozzle 40 downstream of the barrel 6 to extend upwardly (along arrow C) and cause a reactive force E downward and tending to minimize or eliminate recoil. Rather than the prior art omnidirectional expansion (along arrow B following barrel 6 flow A of FIG. 3 in the prior art).

With particular reference to FIGS. 4-11, particular details of the muzzle brake 10 according to a first embodiment are described. In this first embodiment, the muzzle brake 10 is shown attached to a typical prior art semi-automatic pistol and with the propelling nozzle having a generally hemispherical shape, at least on lower portions thereof. The muzzle brake 10 can be formed with the semi-automatic pistol or attached to the semi-automatic pistol, either during initial manufacture or after initial manufacture. Attachment after manufacture could be through utilization of a fastener or through utilization of some bonding technique appropriate for the materials from which the semi-automatic pistol 2 and muzzle brake 10 are formed.

The muzzle brake 10 itself includes a proximal opening 20 opposite of distal opening 30 which accommodates a bullet 16 leaving the barrel 6. The proximal opening 20 is formed on an adjacent surface 22. Sidewalls 24 extend perpendicularly and forwardly away from this adjacent surface 22 on lateral sides of the muzzle brake 10. A bridge 26 spans an upper portion of the proximal opening 20 and generally joins the two sidewalls 24 together at an upper portion of the adjacent surface 22 of the proximal opening 20.

The distal opening 30 is on the side of the muzzle brake 10 opposite the proximal opening 20, and defines a forwardmost portion of the muzzle brake 10. The distal opening 30 passes through a tip surface 32 which is opposite the adjacent surface 22 and with the tip surface 32 generally parallel with the adjacent surface 22. An access tube 34 is preferably provided below the distal opening 30 and extending into the tip surface 32 to align with the guide rod 14 (FIG. 6) and allow access to the guide rod 14 through the access tube 34.

A gap 36 is provided in this embodiment on an upper portion of the tip surface 32, rather than a bridge. This gap 36 causes the distal opening 30 and the outlet of the propelling nozzle 40 to be at least partially joined together. An upper rim 42 surrounds an upper end of the propelling nozzle 40 of the central chamber of the muzzle brake 10, but is interrupted by the gap 36 so that this upper rim 42 surrounds a rear and sides of the propelling nozzle 40 of the muzzle brake 10, but with the upper rim 42 (in this embodiment) discontinuing at forward portions thereof and instead transitioning into the distal opening 30. In another embodiment, this gap 36 could be closed or made smaller than that depicted with the muzzle brake 10 of FIGS. 4-11.

Figure 10:
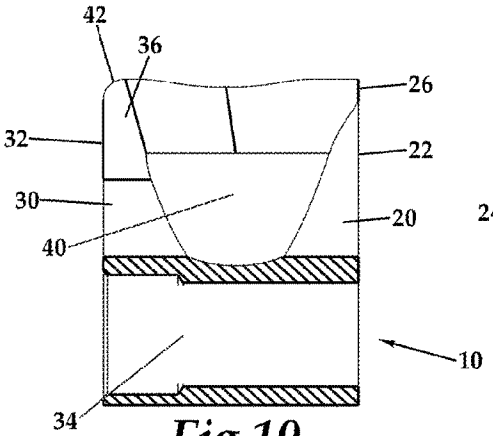
FIG. 10 is a sectional side elevation view of that which is shown in FIG. 7.
Figure 9:
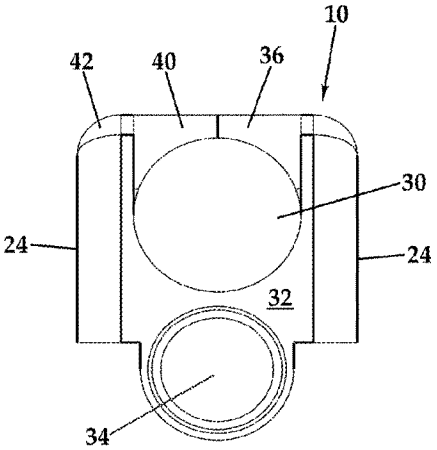
FIG. 9 is a front elevation view of that which is shown in FIG. 7.
Figure 13:
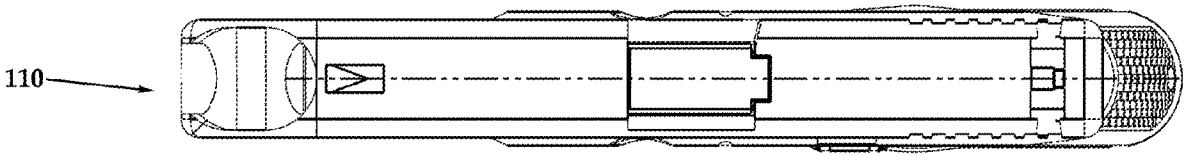
FIG. 13 is a top plan view of that which is shown in FIG. 12.
Figure 14:
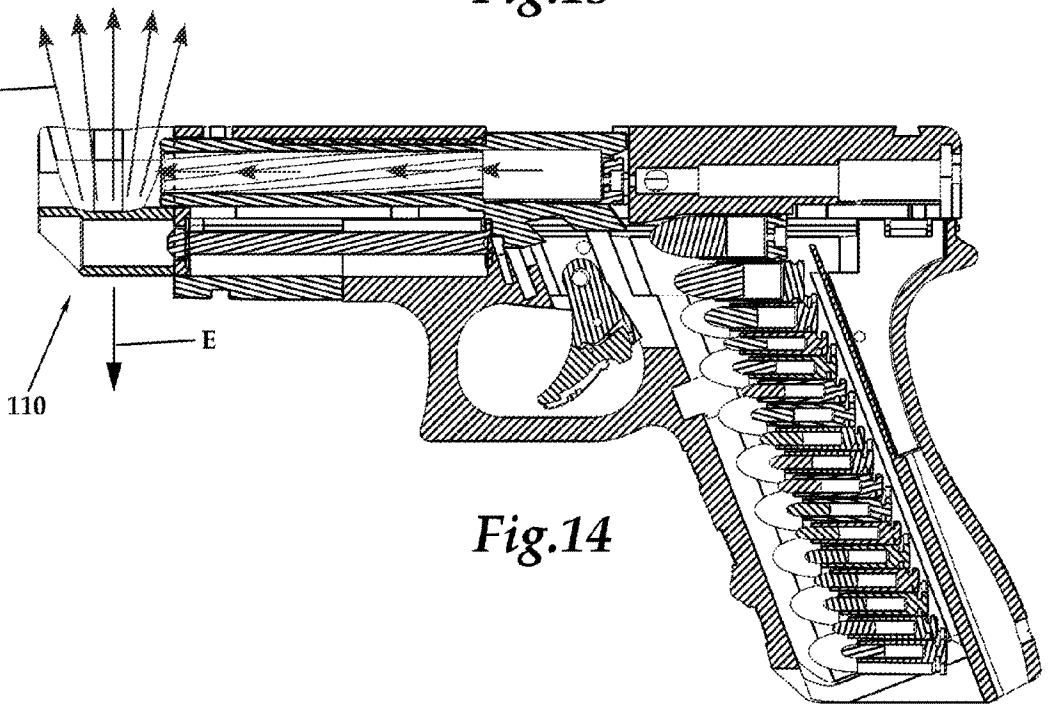
FIG. 14 is a full sectional side elevation view of that which is shown in FIG. 12.
Figure 12:
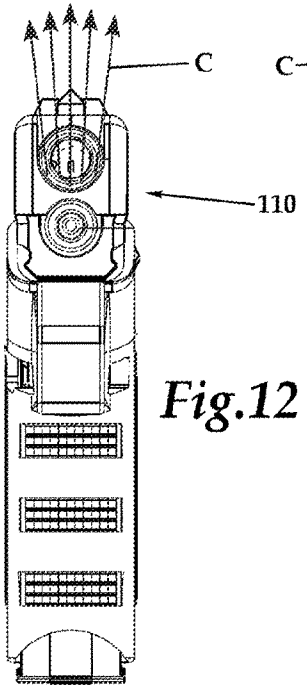
FIG. 12 is a front elevation view of a typical semiautomatic pistol with an alternative embodiment "stadium" shaped propelling nozzle of the invention.
Figure 16:
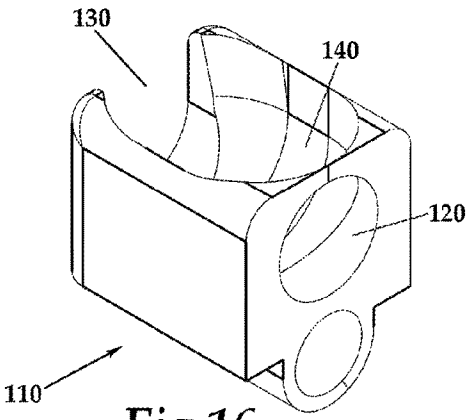
FIG. 16 is an isometric view of that which is shown in FIG. 15.
Figure 15:
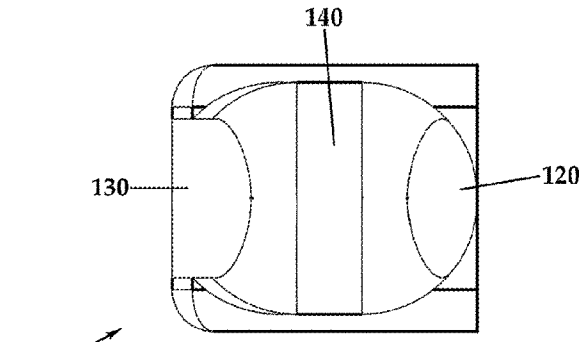
FIG. 15 is a top plan view of the stadium shaped propelling nozzle of FIGS. 12-14 isolated from the firearm, for purposes of illustration.
Figure 19:
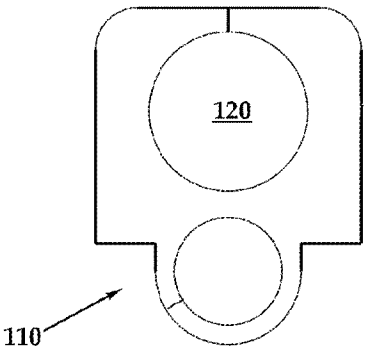
FIG. 19 is a rear elevation view of that which is shown in FIG. 15.
Figure 18:
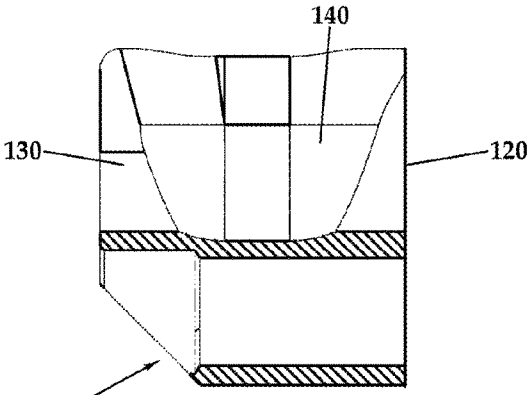
FIG. 18 is a full sectional side elevation view of that which is shown in FIG. 15.
Figure 17:
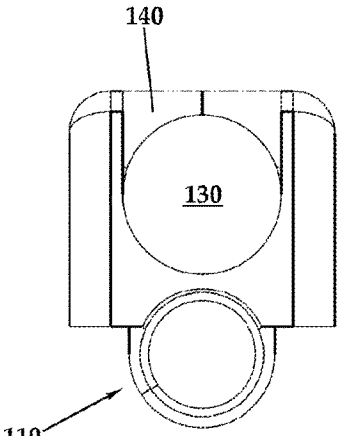
FIG. 17 is a front elevation view of that which is shown in FIG. 15.
Figure 20:
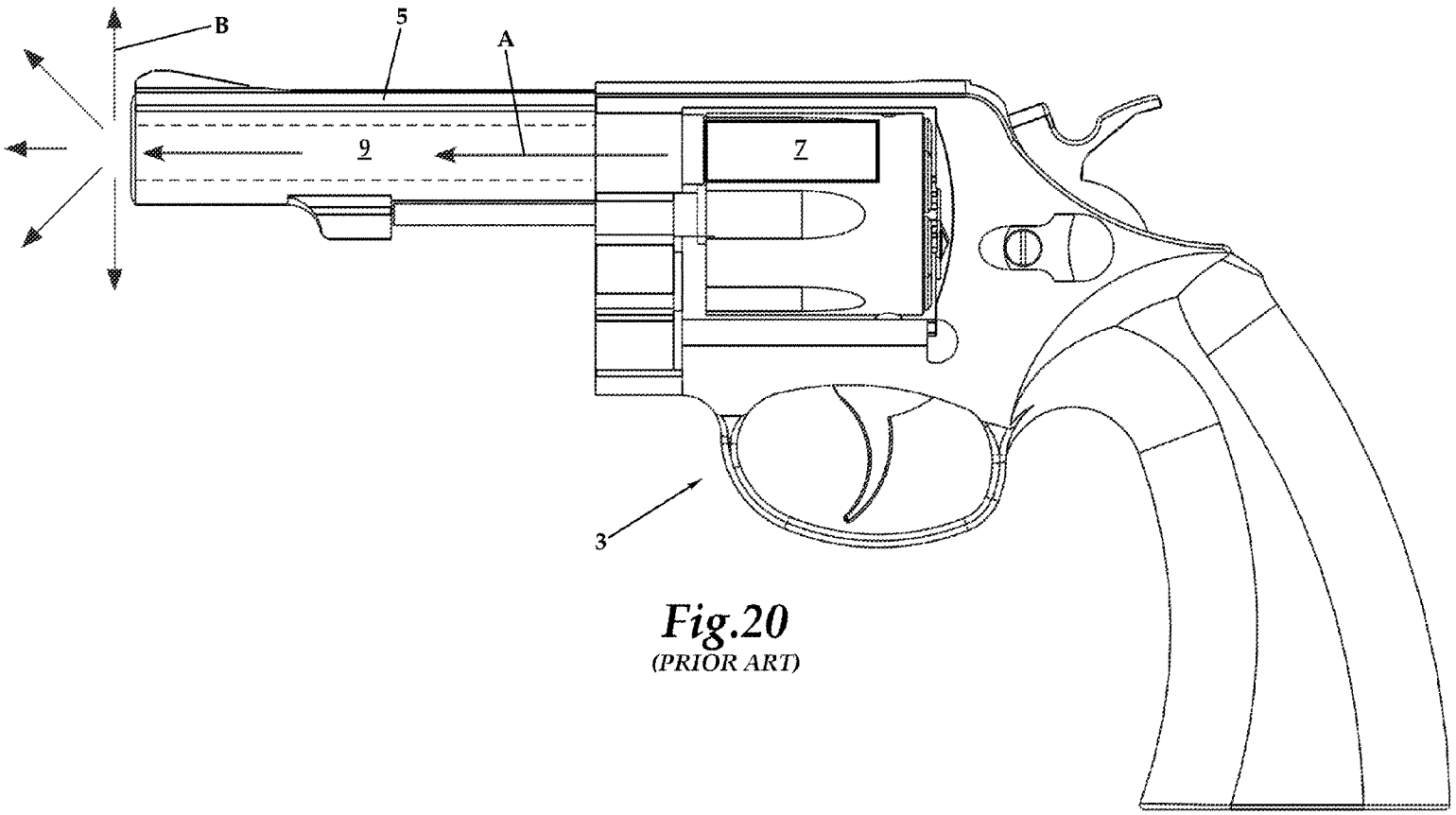
Fig.20 (PRIOR ART)
FIG. 20 is a side elevation view of a typical prior art revolver without the invention.
Figures 21, 22, 23, 24:
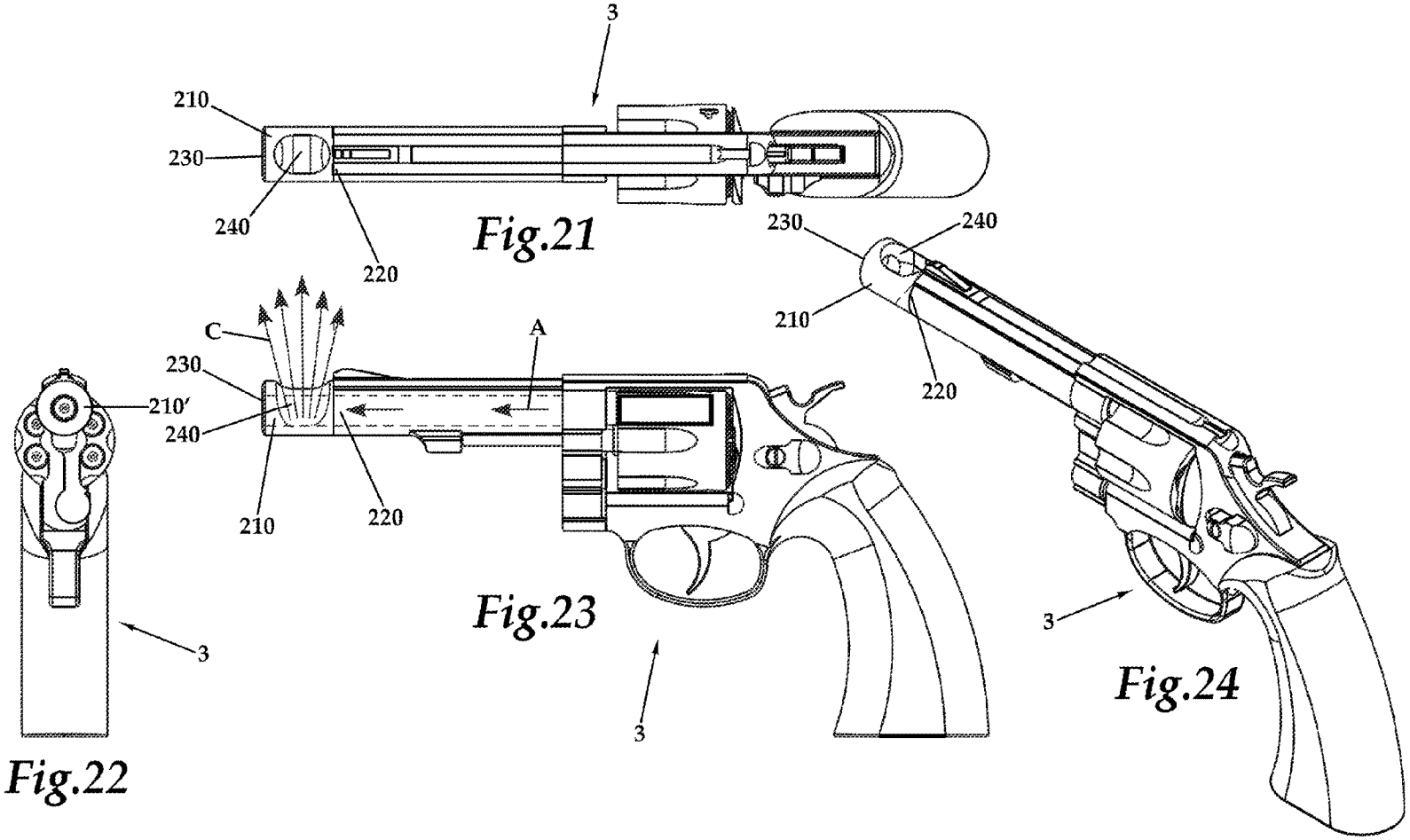
FIG. 21 is a top plan view of a typical revolver with an alternative embodiment of the invention in the form of a "stadium" shaped propelling nozzle, shown in this embodiment with an extension machined into the barrel of the revolver during the original manufacturing process.
FIG. 22 is a front elevation view of that which is shown in FIG. 21.
FIG. 23 is a side elevation partial sectional view of that which is shown in FIG. 21.
FIG. 24 is an isometric view of that which is shown in FIG. 21.
Figures 25, 26, 27, 28:
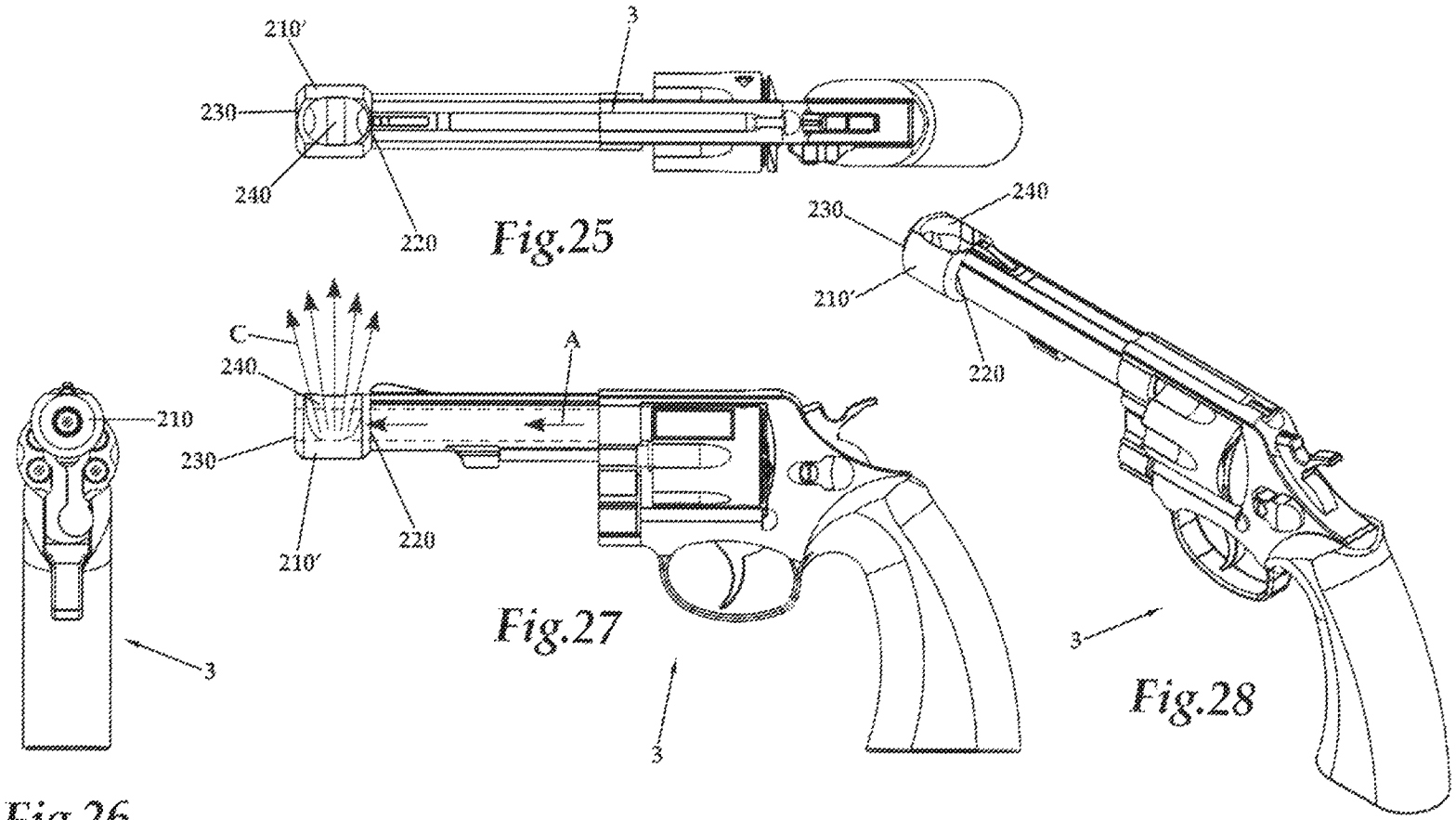
FIG. 25 is a top plan view of a typical revolver with another alternative embodiment in the form of a larger sized stadium shaped propelling nozzle that is created out of an enlarged area on a front end of the barrel, that flares out beyond the normal width of the barrel.
FIG. 26 is a front elevation view of that which is shown in FIG. 25.
FIG. 27 is a side elevation partial sectional view of that which is shown in FIG. 25.
FIG. 28 is an isometric view of that which is shown in FIG. 25.
Figure 30:
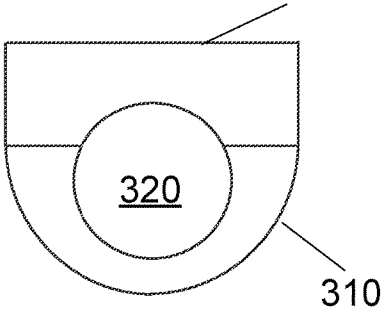
FIG. 30 is a side elevation view of that which is shown in FIG. 29.
Figure 29:
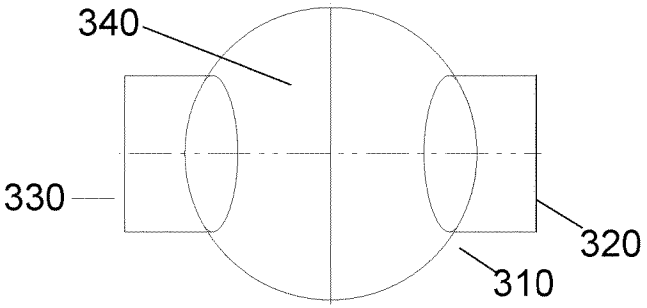
FIG. 29 is a top plan view of a hemispherical propelling nozzle of a further embodiment, uniquely adapted to a built in extension of a firearm, shown in isolation from any surrounding structure for the purposes of illustration.
Figure 32:
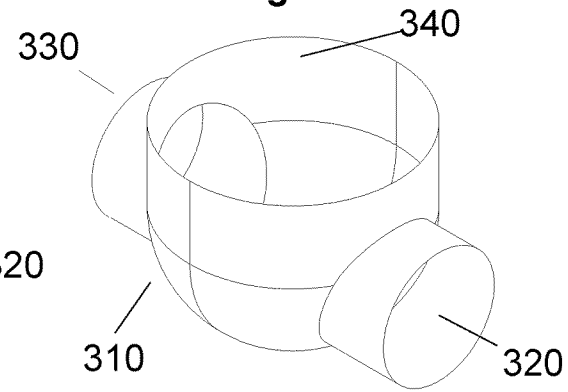
FIG. 32 is an isometric view of that which is shown in FIG. 29.
Figure 31:
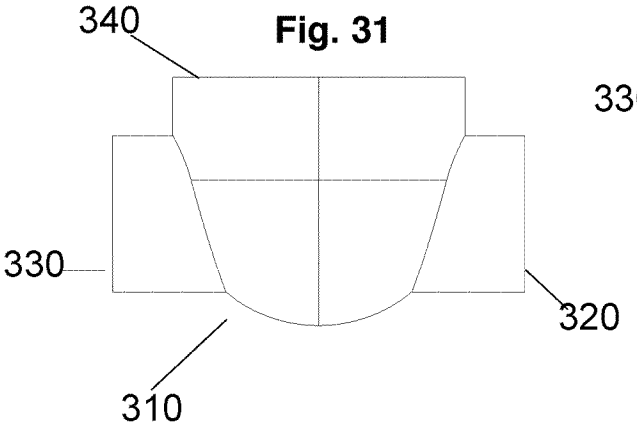
FIG. 31 is a side elevation view of that which is shown in FIG. 29.
Figure 34:
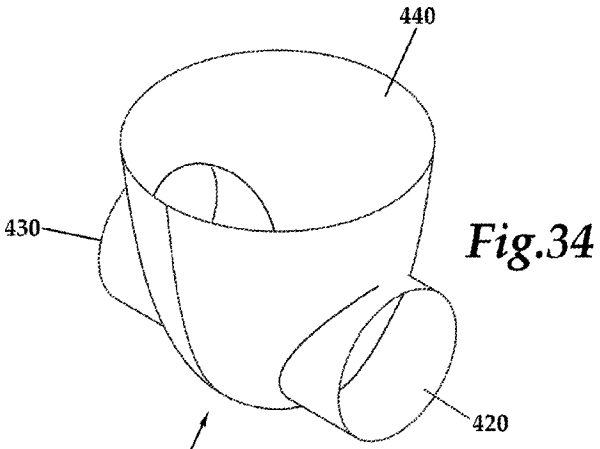
FIG. 34 is an isometric view of that which is shown in FIG. 33.
Figure 36:
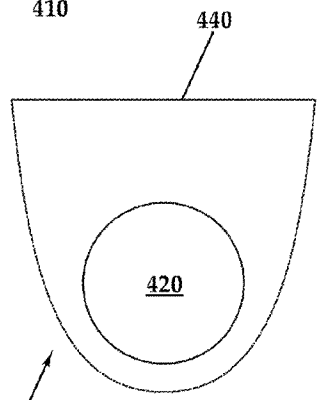
FIG. 36 is a front elevation view of that which is shown in FIG. 33.
Figure 33:
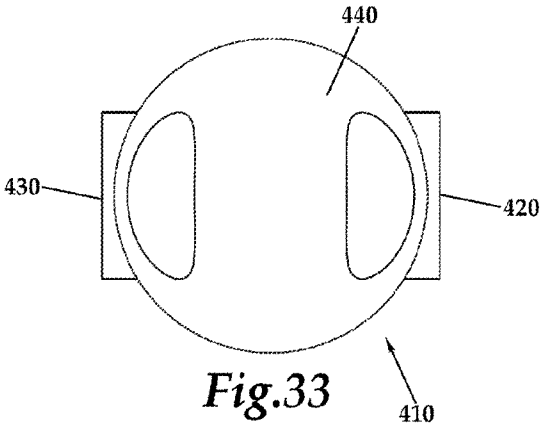
FIG. 33 is a top plan view of an upside down "bell" shaped (and somewhat parabolic) propelling nozzle according to a further embodiment, and uniquely adapted to a built in extension of a firearm, shown in isolation from any surrounding structure for the purposes of illustration.
Figure 35:
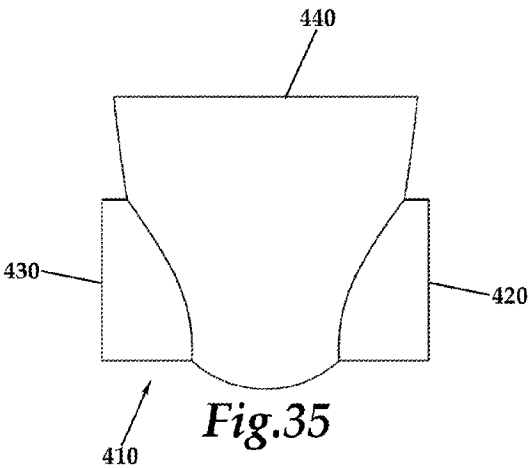
FIG. 35 is a side elevation view of that which is shown in FIG. 33.
Figure 38:
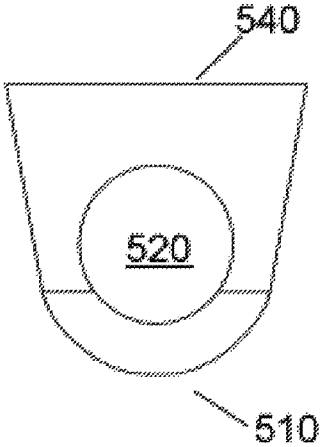
FIG. 38 is a front elevation view of that which is shown in FIG. 37.
Figure 40:
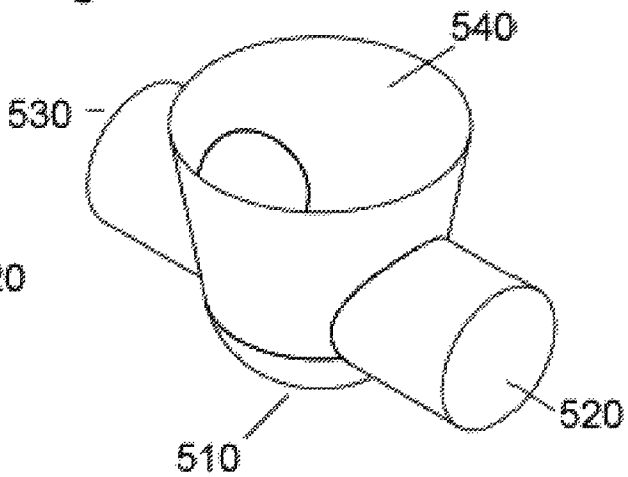
FIG. 40 is an isometric view of that which is shown in FIG. 37.
Figure 37:
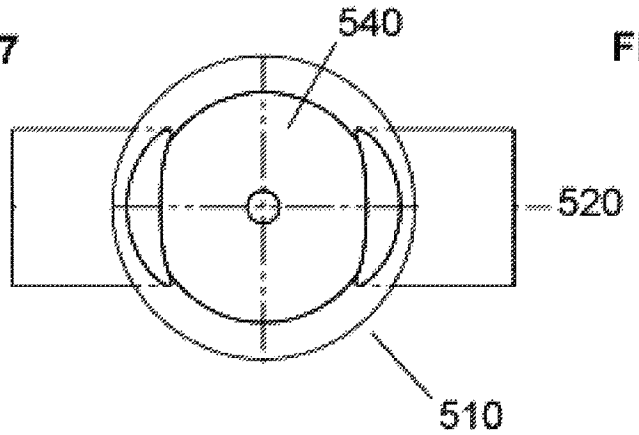
FIG. 37 is a top plan view of a cone shaped propelling nozzle according to a further embodiment, and uniquely adapted to a built in extension of a firearm, shown in isolation from any surrounding structure for the purposes of illustration.
Figure 39:
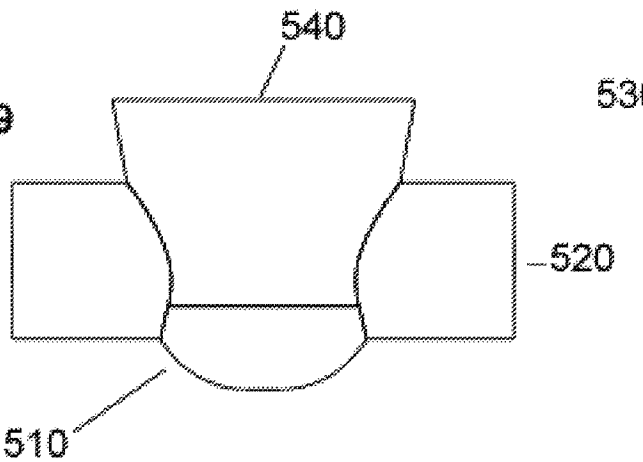
FIG. 39 is a side elevation view of that which is shown in FIG. 37.
Figure 42:
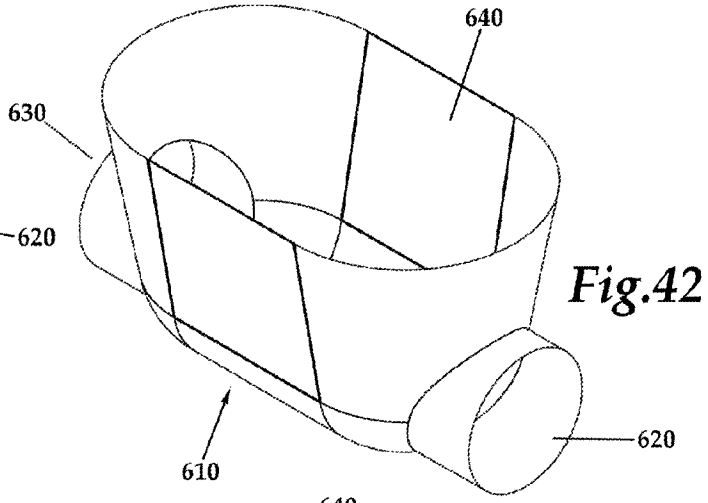
FIG. 42 is an isometric view of that which is shown in FIG. 41.
Figure 44:
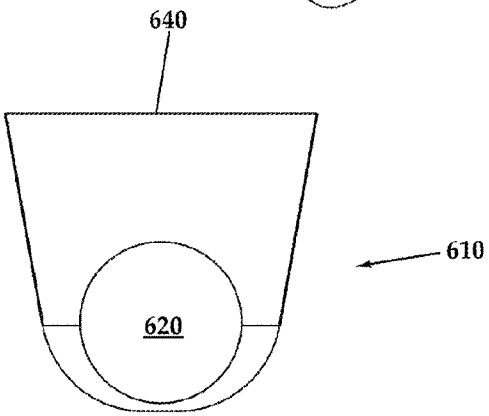
FIG. 44 is a front elevation view of that which is shown in FIG. 41.
Figure 41:
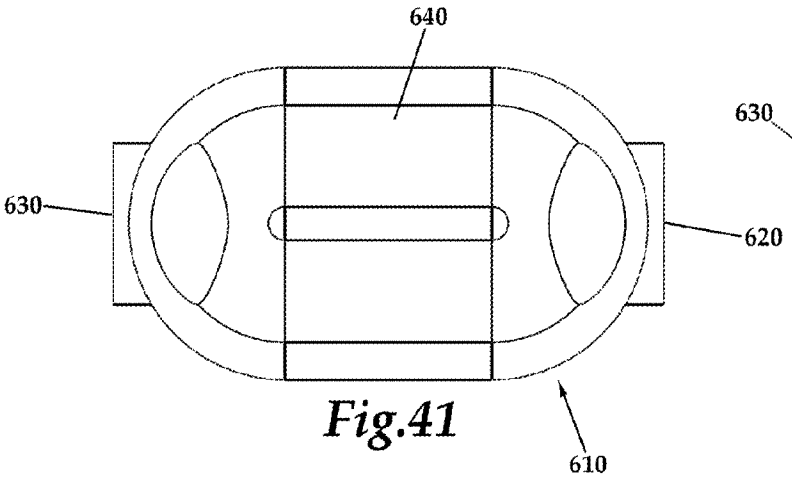
FIG. 41 is a top plan view of an extended cone shaped propelling nozzle of a further embodiment, and uniquely adapted to a built in extension of a firearm. It is shown in isolation from any surrounding structure for the purposes of illustration. An extended cone or other shaped propelling nozzle allows for a longer "burn" time, or time that thrust is created, thus creating greater downward thrust to control recoil. The need for more or less length is determined by the unique needs of a particular caliber and size of a particular firearm.
Figure 43:
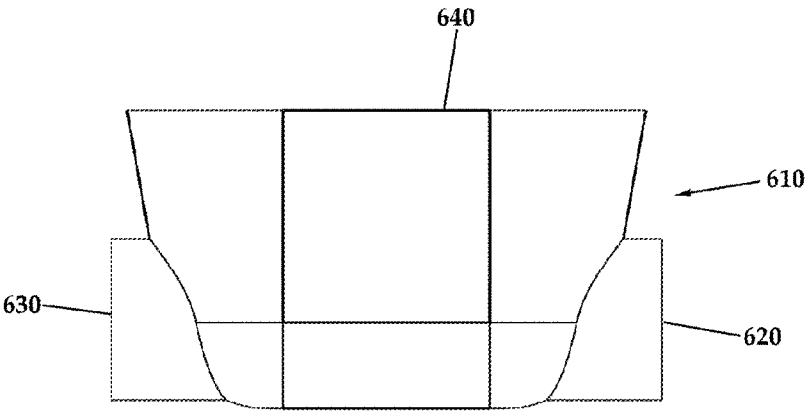
FIG. 43 is a side elevation view of that which is shown in FIG. 41.
Figure 46:
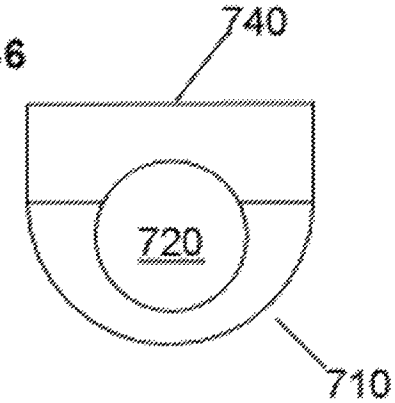
FIG. 46 is a front elevation view of that which is shown in FIG. 45.
Figure 45:
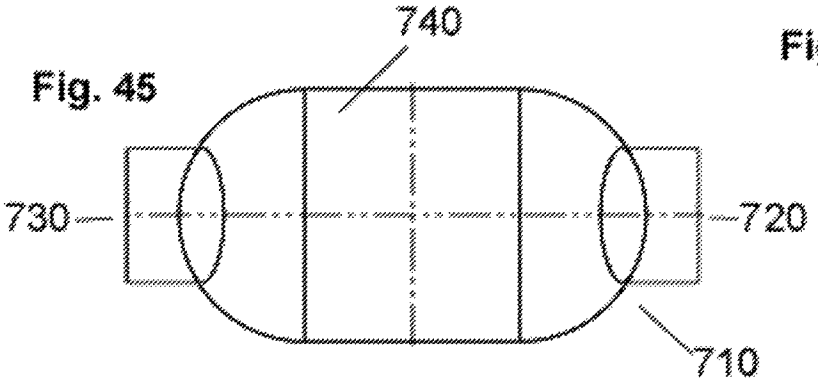
FIG. 45 is a top plan view of an extended hemispherical shaped propelling nozzle of a further embodiment, and uniquely adapted to a built in extension of a firearm, shown in isolation from any surrounding structure for the purposes of illustration.
Figure 48:
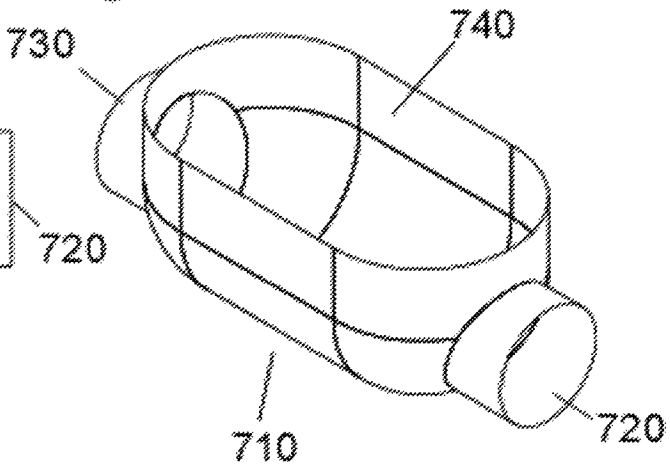
FIG. 48 is an isometric view of that which is shown in FIG. 45.
Figure 47:
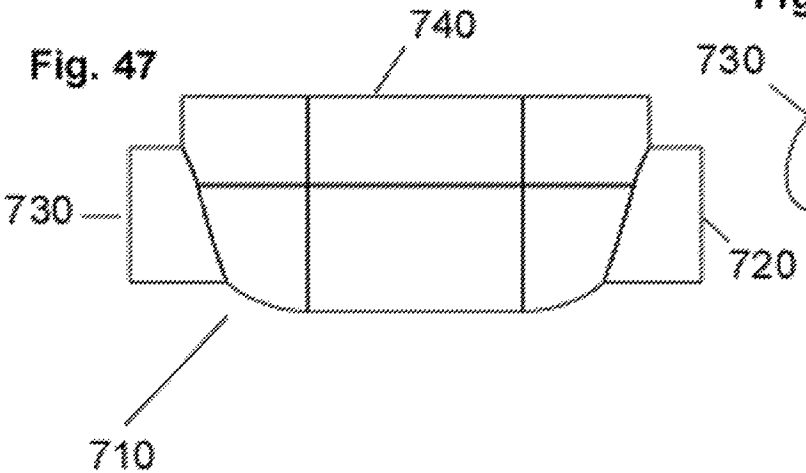
FIG. 47 is a side elevation view of that which is shown in FIG. 45.
Figure 50:
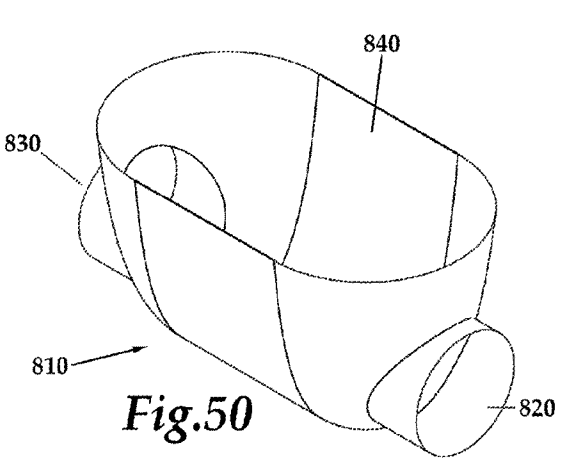
FIG. 50 is an isometric view of that which is shown in FIG. 49.
Figure 49:
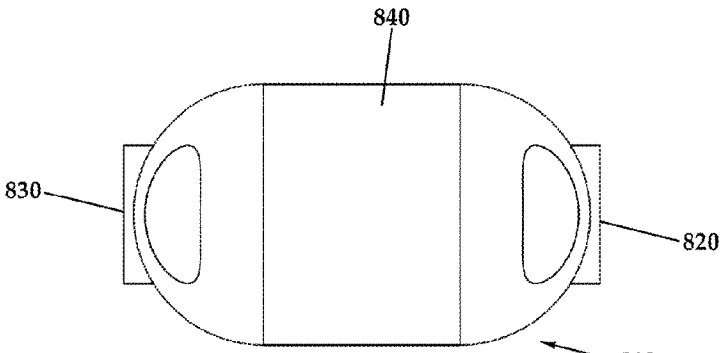
FIG. 49 is a top plan view of an extended bell shaped propelling nozzle, according to a further embodiment, and uniquely adapted to a built in extension of a firearm, shown in isolation from any surrounding structure for the purposes of illustration.
Figure 52:
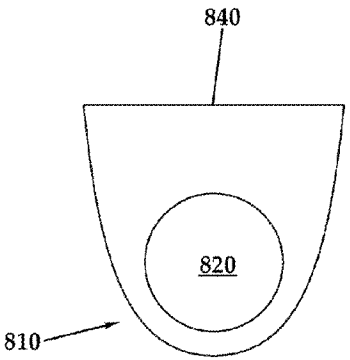
FIG. 52 is a front elevation view of that which is shown in FIG. 49.
Figure 51:
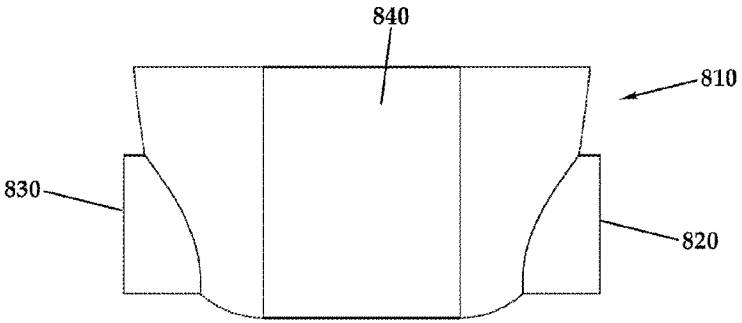
FIG. 51 is a side elevation view of that which is shown in FIG. 49.
Figure 54:
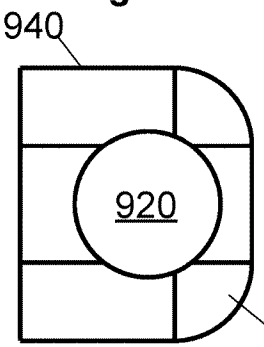
FIG. 54 is a front elevation view of that which is shown in FIG. 53.
Figure 53:
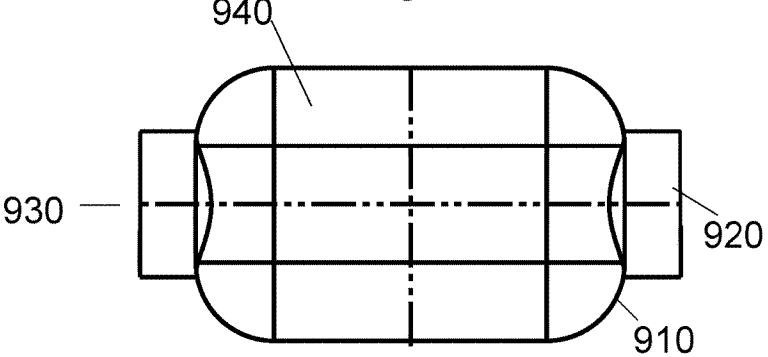
FIG. 53 is a top plan view of an extended stadium shaped and vertical walled propelling nozzle with flattened ends, according to a further embodiment, and uniquely adapted to a built in extension of a firearm, shown in isolation from any surrounding structure for the purposes of illustration.
Figure 56:
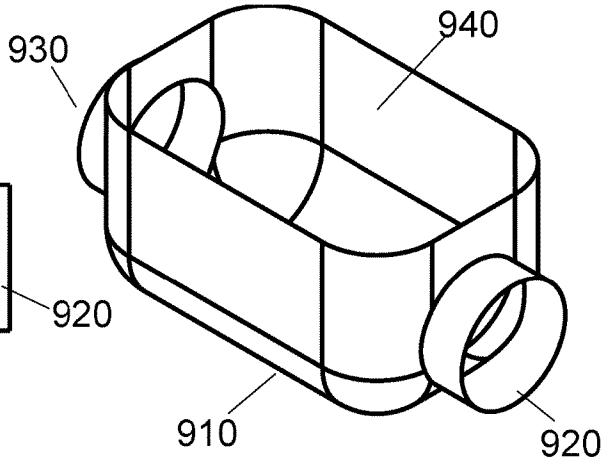
FIG. 56 is an isometric view of that which is shown in FIG. 53.
Figure 55:
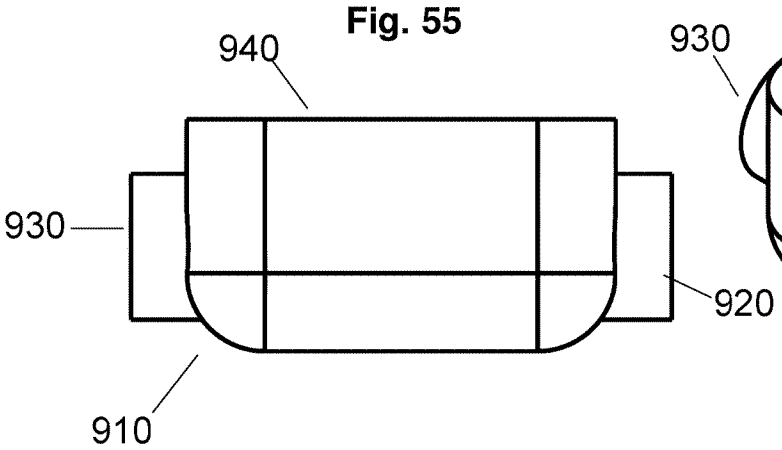
FIG. 55 is a side elevation view of that which is shown in FIG. 53.
Figure 58:
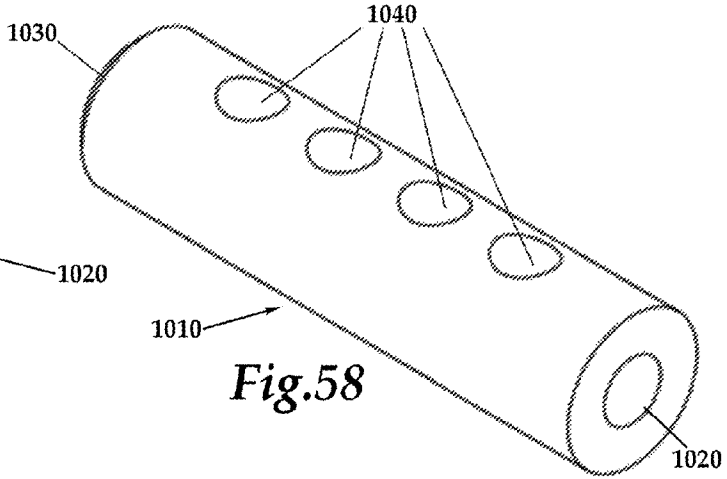
FIG. 58 is an isometric view of that which is shown in FIG. 57.
Figure 60:
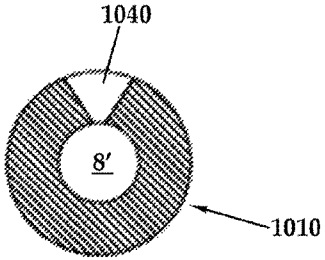
FIG. 60 is a front elevation full sectional view of that which is shown in FIG. 57 and cut through a center of one of the conical shaped propelling nozzles.
Figure 57:
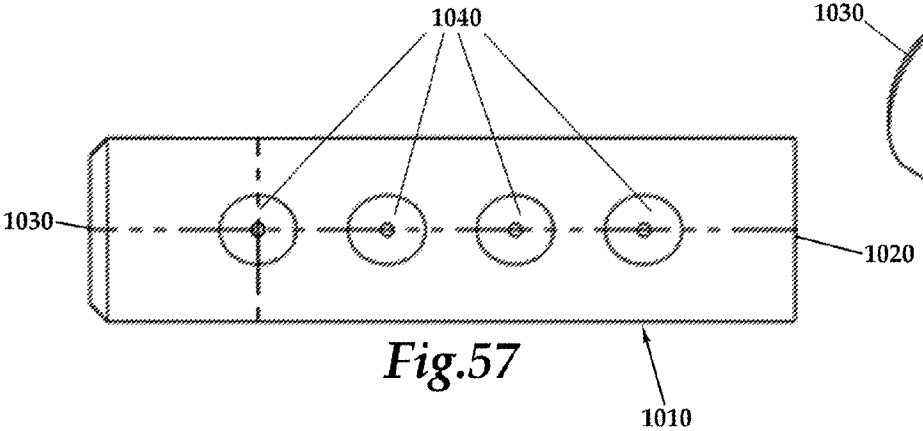
FIG. 57 is a top plan view of a further alternative embodiment, featuring multiple conical shaped propelling nozzles, as could be adapted for use with long guns such as rifles or shotguns. Due to the higher compression or gas pressure of the larger cartridges used in these firearms, smaller propelling nozzles may be appropriate. In this embodiment, a row along the top of muzzle brake allows the compressed gases to enter the nozzle from below, as the lowest end of the conical propelling nozzle creates an opening into the barrel of the firearm.
Figure 59:
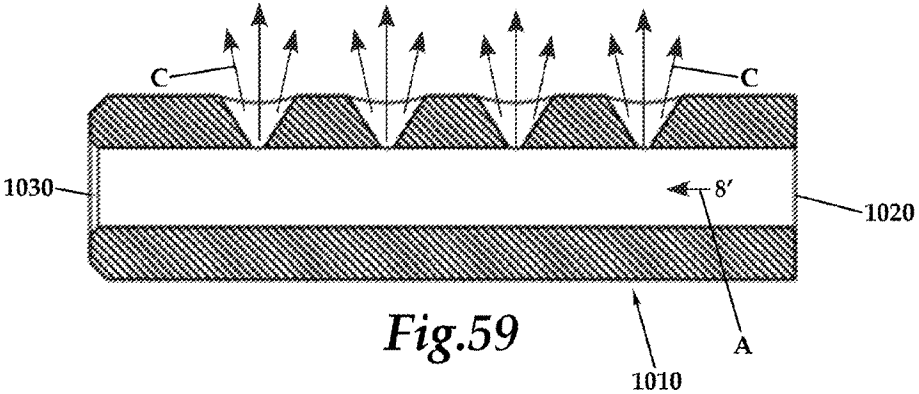
FIG. 59 is a side elevation full sectional view of that which is shown in FIG. 57.
Figure 62:
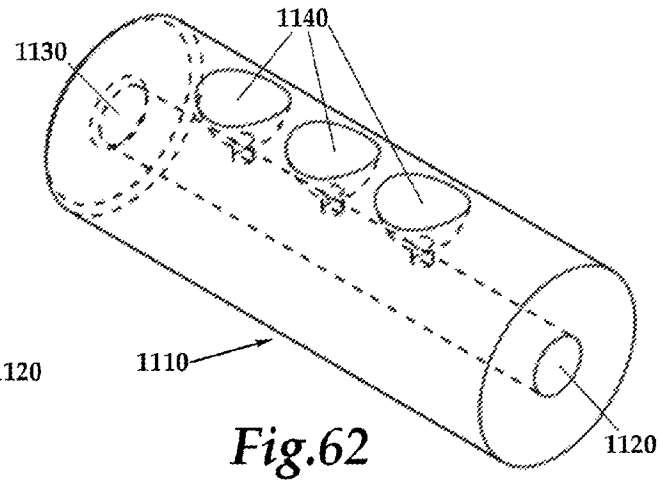
FIG. 62 is an isometric view of that which is shown in FIG. 61 and with interior details shown in broken lines.
Figure 64:
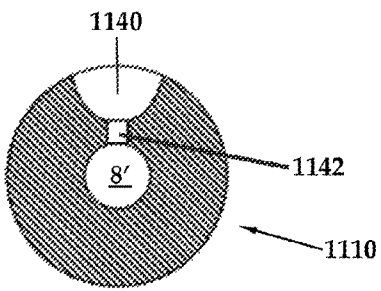
FIG. 64 is a front elevation full sectional view of that which is shown in FIG. 61 and with interior details shown in broken lines; and cut through a center of one of the bell shaped propelling nozzles and with a short cylindrical "throat" that allows combustion gases to travel from the barrel up into the base of the propelling nozzle.
Figure 61:
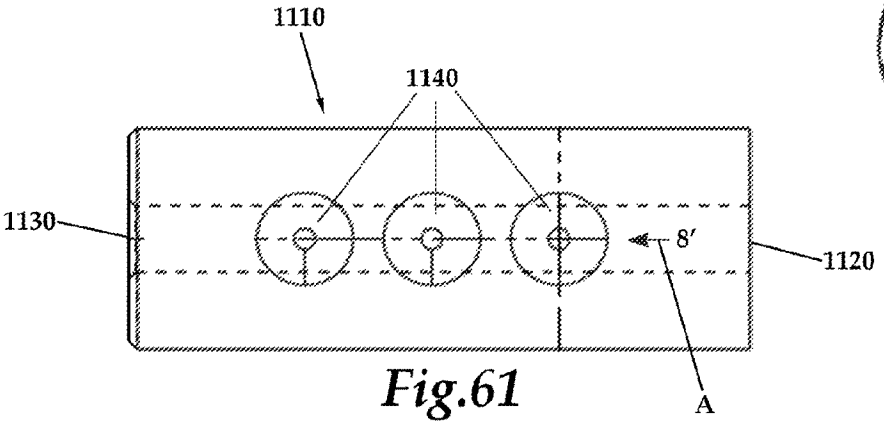
FIG. 61 is a top view of a further alternative embodiment, featuring multiple bell shaped propelling nozzles, as could be adapted for use with long guns such as rifles or shotguns. In this embodiment, a row along the top of muzzle brake allows the compressed gases to enter the nozzle from below.
Figure 63:
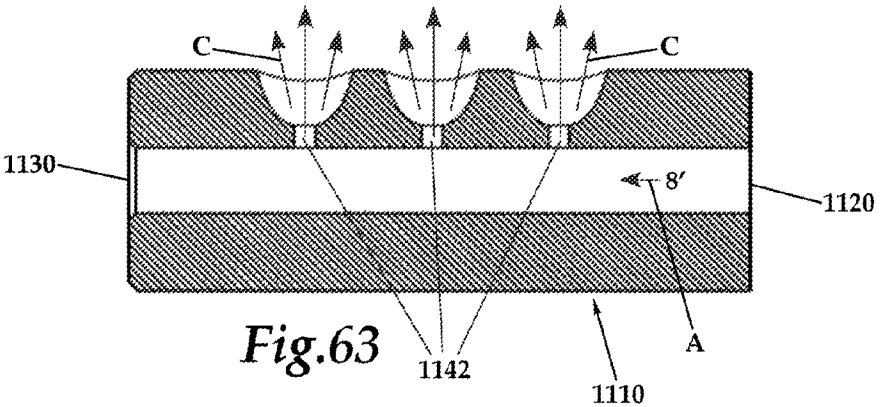
FIG. 63 is a side elevation full sectional view of that which is shown in FIG. 61 and with interior details shown in broken lines
Figure 65:
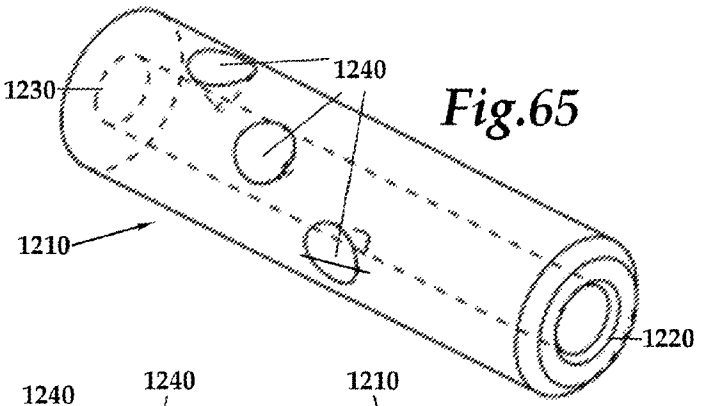
FIG. 65 is an isometric view of a variation of that which is shown in FIGS. 57-60 with the nozzles spaced along a spiral path, and with interior details shown in broken lines.
Figure 69:
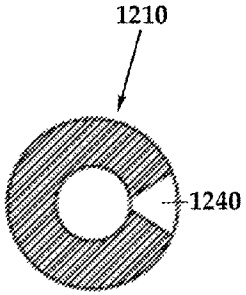
FIGS. 67-69 show front elevation sectional "slices" showing the position of the spirally arranged nozzles.
Figure 68:
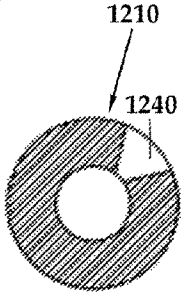
Figure 67:
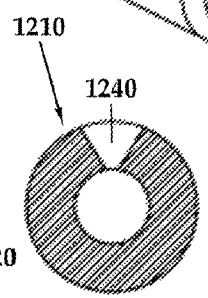
Figure 66:
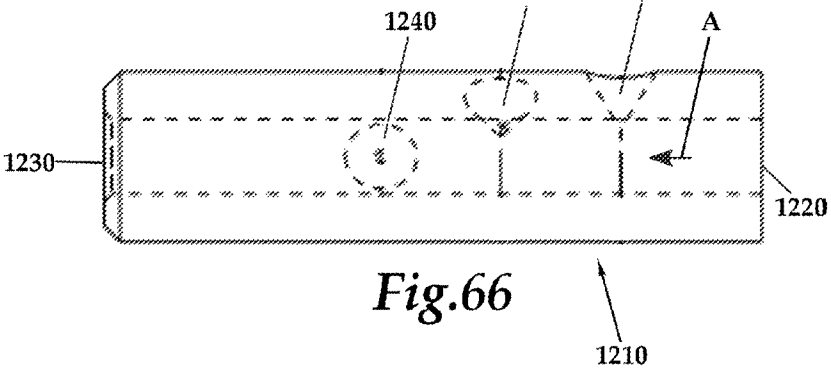
FIG. 66 is a side elevation view of that which is shown in FIG. 65 and with interior details shown in broken lines.
Figure 71:
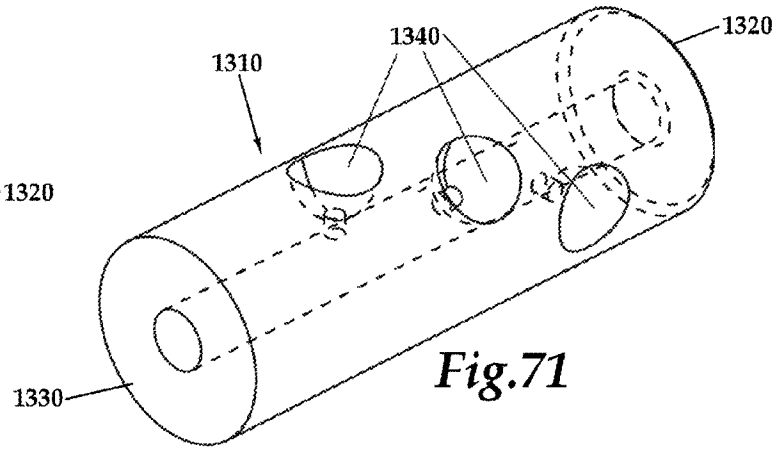
FIGS. 70-73 are side elevation, isometric, side full sectional and end elevation views of an alternative embodiment to that of FIGS. 65-69 with a bell shaped series of nozzles following a spiral arrangement.
Figure 73:
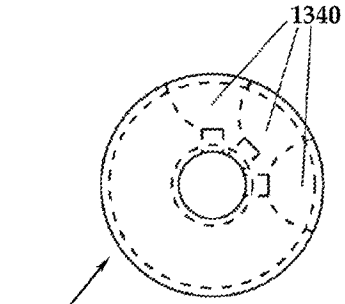
Figure 70:
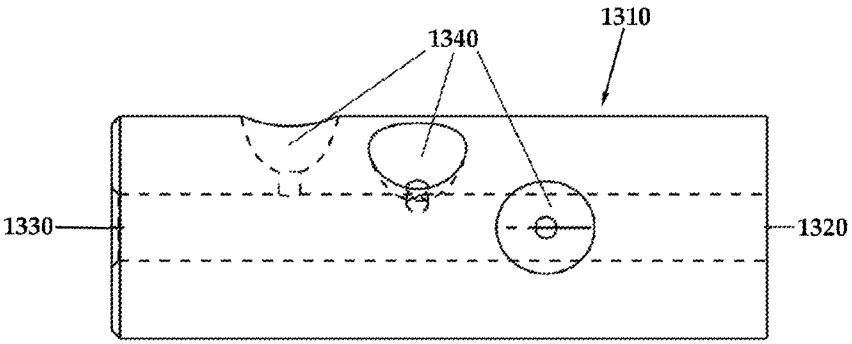
Figure 72:
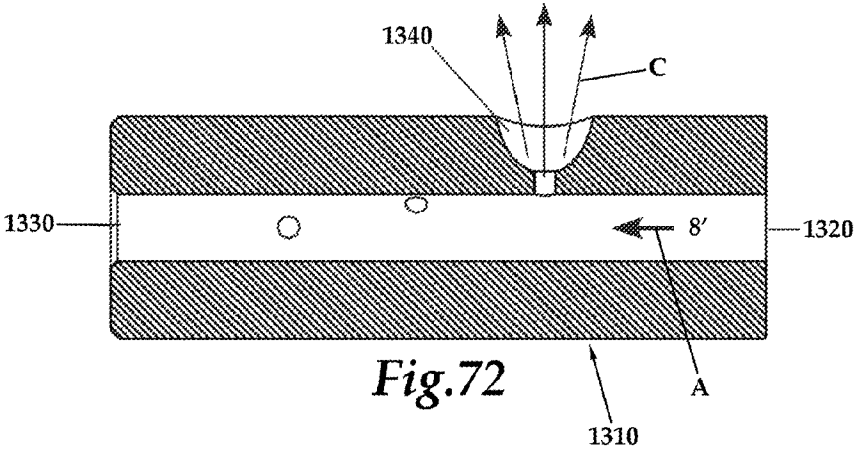

The hemispherical shape of the propelling nozzle 40 with this muzzle brake 10 causes the central chamber of the muzzle brake 10 to have a smaller cross-sectional area at lower portions thereof and to become larger and larger as it extends upwardly. In FIG. 10 a cross-section of the propelling nozzle 40 is perhaps most clearly shown. While it is somewhat parabolic in this figure, it could be purely hemispherical for portions thereof and then transition into a frustoconical outwardly tapering form for upper portions thereof. By having the propelling nozzle 40 taper as is it extends upwardly, and it acts like a nozzle, tending to produce a force vector in a generally downward direction and counteracting recoil.

Lowermost portions of the central chamber can extend slightly downward below the distal opening 30 and proximal wall opening 20, if desired, and as shown. In use, upon discharge of the firearm, the projectile 18 would first pass through the proximal opening 20 and then the distal opening 30, passing through a lower portion of the central chamber of the propelling nozzle 40. Just behind the projectile 18, the high-pressure gases which are projecting the projectile 18, reach the central chamber. These gases then expand primarily upwardly, but also continuing somewhat forwardly, both through the gap 36 and through the distal opening 30. To the extend the gasses are expanding upwardly (along arrow C of FIG. 6 for instance), and especially interacting with the hemispherical or otherwise shaped walls of the propelling nozzle 40, the reaction force upon the muzzle brake 10 is generally downward and counteracting recoil.

While the first instance of recoil is at discharge of the firearm, and this propelling nozzle 40 force vector downward through the muzzle brake 10 action occurs slightly later, this time differential is so small that the recoil action has barely begun before this compensating downward force vector is provided, and ameliorates at least portions of the recoil. Many other embodiments are also depicted herein showing variations which can be beneficial in various embodiments for various reasons. For instance, some embodiments maybe easier to machine. Other embodiments may be preferable for certain particular calibers of firearms or for firearms which have other particular configurations. In addition, various combinations of the particular cross-sectional forms of propelling nozzles for various alternative muzzle brakes 10 according to other embodiments of this invention could be combined together as further design alternatives.

With particular reference to FIGS. 12-19, a first alternative muzzle brake 110 is disclosed having a "stadium" cross-section for the central chamber thereof. With this first alternative muzzle brake 110, a proximal opening 120 is provided opposite a distal opening 130 and with the propelling nozzle 140 therebetween and extending upwardly. This propelling nozzle 140 has a shape distinct from that of the muscle brake 10 of the first embodiment and that it is somewhat elongated in a direction parallel with a central line passing through the openings 120, 130. Thus, the central region of the propelling nozzle 140 is provided with a substantially constant vertical cross-section perpendicular to the centerline passing through the openings 120, 130, for some distance between distal and proximal ends of the central chamber of the propelling nozzle 140.

With particular reference to FIGS. 20-28, details of a second alternative muzzle brake 210 are described. The second alternative muzzle brake 210 has a proximal opening 220 opposite a distal opening 230 and with a propelling nozzle 240 there between. The propelling nozzle 240 extends up from a central chamber with a shape defining a "closed stadium." In particular, this propelling nozzle 240 is "closed" by a forward bridge 236 which arches over upper portions of the distal opening 230. An upper rim surrounding the upper portions of the propelling nozzle 240 is this complete in form as it surrounds the propelling nozzle 240 at upper portions thereof. This embodiment also shows the muzzle brake 210 attached to a revolver 3 as an alternative to previously disclosed embodiments. Gas discharge along arrow C is depicted which produces a downward force counteracting recoil.

With particular reference to FIGS. 29-32, details of a third alternative embodiment muzzle brake 310 are described. With this third alternative muzzle brake 310, a proximal opening 320 is provided opposite of distal opening 330 and with a propelling nozzle 340 therebetween. This propelling nozzle 340 had a central chamber with a form which is considered to be rather purely "hemispherical." Lower portions of the central chamber form a hemisphere with the largest diameter at an upper portion of. Upper portions of the central chamber are cylindrical in form and extend up from the hemispherical lower portion thereof.

With particular reference to FIGS. 33-36, details of a fourth alternative embodiment muzzle brake 410 are described. The fourth alternative muzzle brake 410 has a proximal opening 420 opposite of distal opening 430 with a projecting nozzle 440 therebetween. The projecting nozzle 440 of this fourth alternative muzzle brake 410 has an inverted "bell" shape which is somewhat parabolic with a continuous tapering as it extends upwardly.

With particular reference to FIGS. 37-40, details of a fifth alternative embodiment muzzle brake 510 are described. The fifth alternative muzzle brake 510 includes a proximal opening 520 opposite of distal opening 530 and with a projecting nozzle 540 located therebetween. The projecting nozzle 540 has a central chamber which is generally cone shaped in this embodiment. In particular, lower portions of the central chamber are somewhat parabolic and/or hemispherical, but upper portions of the cone shaped central chamber of the projecting nozzle 540 are frustoconical in form tapering to a larger diameter as the projecting nozzle 540 extends upwardly.

With particular reference to FIGS. 41-44, details of a sixth alternative embodiment muzzle brake 610 are described. The sixth alternative muzzle brake 610 extends from the proximal opening 622 to a distal opening 630 and with a projecting nozzle 640 therebetween. The projecting nozzle 640 has a central chamber with an extended cone shaped form. This extended cone shaped form extends along a center line passing through the openings 620, 630 so that in many ways this extended cone shape for the central chamber of the projecting nozzle 640 relates to the second alternative muzzle brake 210 (FIGS. 21-28). However, with the sixth alternative muzzle brake 610, the constant taper angle associated with the fifth alternative muzzle brake 510 (FIGS. 37-40) is continued, but with an elongated form in the sixth alternative embodiment muzzle brake 610.

With particular reference to FIGS. 45-48, details of a seventh alternative embodiment muzzle brake 710 are described. The seventh alternative embodiment muzzle brake 710 includes a proximal opening 720 opposite a distal opening 730 and with a propelling nozzle 740 therebetween. The projecting nozzle 740 has a central chamber which has an extended hemispherical form. This extended hemispherical form is somewhat of an amalgamation of the third alternative embodiment muzzle brake 310 and the second alternate muzzle brake 210. It has a pair of hemispherical forward and rearward lower portions adjacent to the proximal opening 720 and distal opening 730, but with a semi-cylindrical portion there between, and with a portion which is generally cylindrical at forward and rearward edges and which are planer at midpoints of upper portions of the central chamber of the propelling nozzle 740.

With particular reference to FIGS. 49-52, details of an eighth alternative embodiment muzzle brake 810 are described. With the eight alternative embodiment muzzle brake 810, a proximal opening 820 is provided opposite a distal opening 830, and with a projecting nozzle 840 therebetween. The projecting nozzle 840 includes a central chamber which has extended bell shaped form, being somewhat of an amalgamation of the fourth alternative muzzle brake 410 (FIGS. 33-36) and the closed stadium shape of the second alternative embodiment muzzle brake 210 (FIGS. 21-28). With this extended bell shaped projecting nozzle 840, vertical cross-sections perpendicular to a central line passing through the proximal opening and distal opening each have a somewhat parabolic form diverging to a greater and greater width as the projecting nozzle 840 extends upwardly.

With particular reference to FIGS. 53-56, details of a ninth alternative embodiment muzzle brake 910 are described. With the ninth alternative muzzle brake 910, a proximal opening 920 is provided opposite of distal opening 930, and with the projecting nozzle 940 located therebetween. The projecting nozzle 940 has a central chamber with an extended stadium shape which in many ways has a shape similar to that of a rectangle with rounded corners, both when viewed through vertical plane sections and horizontal plane sections, and generally allows gases to expand upwardly to produce a reaction force to counteract recall.

With particular reference to FIGS. 57-60, details of a tenth alternative embodiment muzzle brake 1010 are described. With the tenth alternative muzzle brake 1010, a series of separate projecting nozzles 1040 are provided between a proximal opening 1020 and a distal opening 1030. These projecting nozzles 1040 in this tenth embodiment muzzle brake 1010 are aligned along a line extending between the proximal opening 1020 and the distal opening 1030, and each located on uppermost portions of the muzzle brake 1010. With this embodiment, each projecting nozzle 1040 is shown with a conically tapering form with a larger diameter at uppermost portions thereof, and to allow for expanding gases to provide a downward force correcting recoil. In the embodiment depicted, four such projecting nozzles 1040 are provided, but a greater or less or number of projecting nozzles 1040 could alternatively be utilized, and the shape could copy those of other embodiments, or have other shapes.

With particular reference to FIGS. 61-64, details of an eleventh embodiment muzzle brake 1110 are described. With the eleventh embodiment muzzle brake 1110, a proximal opening 1120 is provided opposite of distal opening 1130. A series of projecting nozzles 1140 are provided along a line at upper portions of the muzzle brake 1110. Each of these propelling nozzles 1140 in this embodiment would have a somewhat spherical or parabolic cross-sectional form to allow expanding gases to provide a downward response force to counteract recoil. In this embodiment, three such propelling nozzles 1140 are shown, but a greater or less or number of propelling nozzles 1140 could be provided.

With particular reference to FIGS. 65-69, details of a twelfth embodiment muzzle brake 1210 are described. The twelfth embodiment muzzle brake 1210 includes a proximal opening 1220 opposite of distal opening 1230 and with a series of propelling nozzles 1240 provided there between. In this embodiment, the series of propelling nozzles are each provided facing in different directions, following a spiral path leading between the proximal opening 1220 and the distal opening 1230. These propelling nozzles 1240 in this embodiment have a conical cross-sectional form and are shown with three such propelling nozzles 1240. The propelling nozzles 1240 provide both a downward force and a lateral force in this embodiment. Some handguns produce a recoil which is not only in an upward direction but also in the lateral direction, which can depend on whether the user is holding the handgun in a left or right hand. With this propelling nozzle 1240, both the lateral and upward recoil can be counteracted at least partially. A greater or lessor number of propelling nozzles 1240 could be provided, and the position and orientation could be adjusted to accommodate particular needs of a user (left or right handed, etc.) and particular details of the operation of particular firearms.

With particular reference to FIGS. 70-73 a thirteenth alternative embodiment muzzle brake 1310 is disclosed. With this thirteenth alternative embodiment muzzle brake 1310, a proximal opening 1320 is provided opposite of distal opening 1330, and with a projecting nozzle 1340 series provided therebetween. These projecting nozzles 1340 are parabolic in cross-sectional form. Also, they are provided along a spiraling pattern similar to that disclosed above in conjunction with the twelfth alternative embodiment muzzle brake 1210 (FIGS. 65-69). With the thirteenth alternative embodiment muzzle brake 1310, the parabolic projecting nozzles 1340 follow spiraling pattern to provide both vertical and lateral recoil compensating forces. Also, in this embodiment the projecting nozzles 1340 have a lowermost portion defined by a throat. This throat is generally in the form of a cylindrical short segment leading from a barrel of the muzzle brake 1310 to each projecting nozzle 1340. A length of such a throat can be selected, as well as the size of such a throat through experimentation or calculations to optimize recoil counteracting forces.

Figure 74:
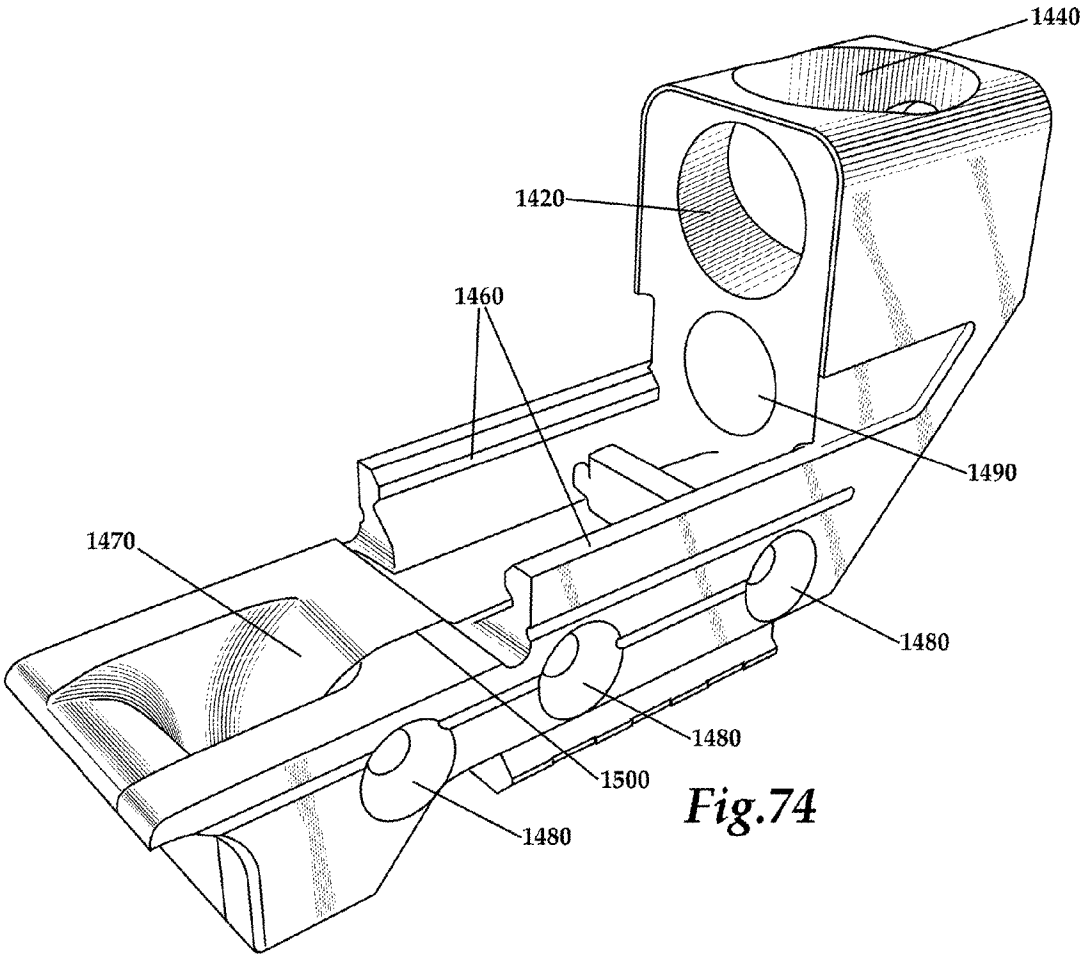
FIG. 74 is a perspective view of a clamping "rail" style attachment device showing an alternative method of attaching a propelling nozzle to a firearm, in this case a semiautomatic pistol, utilizing a two part clamping system for attachment to an existing semi-automatic pistol.
Figure 75:
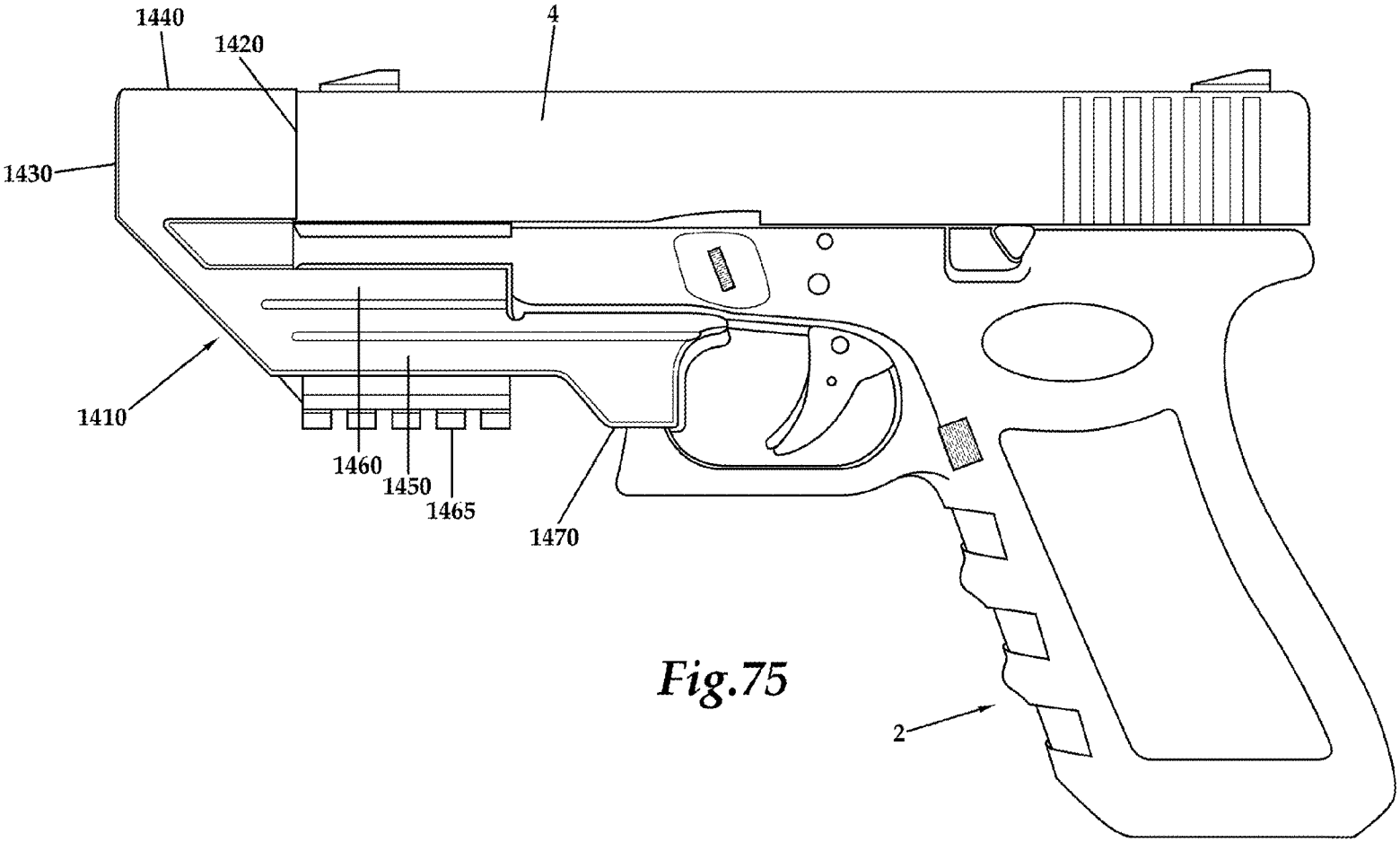
FIG. 75 is a side elevation view of a typical semiautomatic pistol with the rail/clamp on muzzle brake of FIG. 74 featuring a propelling nozzle, attached to the pistol.
Figure 76:
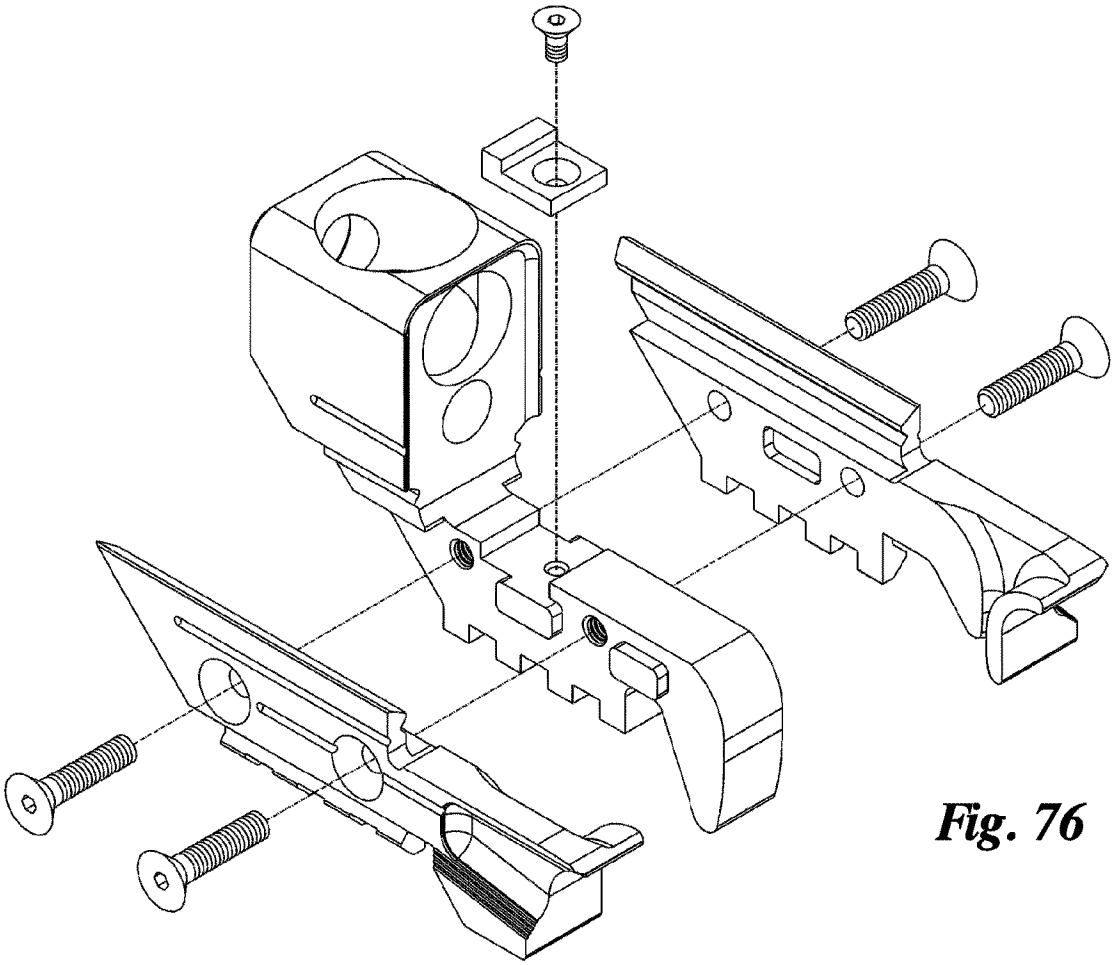
FIG. 76 is an exploded perspective view of that which is shown in FIG. 74, further illustrating how the assembly attaches together and to the firearm, as shown in FIG. 75.

With particular reference to FIGS. 74-76, details of a fourteenth alternative embodiment muzzle brake 1410 are described. With the fourteenth alternative embodiment muzzle brake 1410, a muzzle brake is provided which is removably attachable to a firearm, such as a semi-automatic pistol 2. The muzzle brake 1410 is configured particularly so that it can be removably attached to an existing firearm, with little or no modification of the firearm, and to facilitate providing the benefits of the recoil amelioration of this invention to existing firearms in a simple and effective manner.

The muzzle brake 1410 includes a proximal opening opposite of distal opening 1430 and with a projecting nozzle 1440 therebetween which can have any of a variety of different configurations such as those disclosed in various embodiments above. Importantly, this projecting nozzle 1440 is supported by separate two part lower body 1450 configured to reside beneath the slide and/or frame of the pistol 2. The lower body 1450 preferably includes picatinny clamps 1460 which facilitate attachment of the halves of the lower body 1450 together and to a picatinny rail of a firearm so configured. A trigger guard clamp 1470 is also preferably provided which allows for attachment of the lower body 1450 at least partially to a trigger guard portion of the firearm.

With attachment at two locations, the lower body 1450 can be secured in a very rigid fashion to the firearm. Bolts 1480 pass through left and right halves of the muzzle brake 1410 to hold the halves together and to allow them to be attached to the firearm. The lower body 1450 preferably included an auxiliary picatinny rail 1465 thereon to facilitate attachment of scopes and other accessories to the firearm. An access tube 1490 extends into a forward portion of the muzzle brake 1410 to allow for access to the guide rod. A seam 1500 defines a central line between the two halves which come together to form the lower portions of this removably attachable muzzle brake 1410 according to this embodiment.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A muzzle brake for a barrel of a firearm, comprising in combination:

the muzzle brake structure located at a muzzle end of the barrel;

the muzzle brake structure including a central chamber with a proximal opening and a distal opening, said proximal opening and said distal opening on opposite sides of said central chamber;

said proximal opening and said distal opening each oriented along a centerline co-linear with and extending beyond the muzzle end of the barrel of the firearm;

said proximal opening and said distal opening each sized large enough to allow a bullet discharged from the muzzle end of the barrel to pass through both said proximal opening and through said distal opening;

a propelling nozzle extending at least partially from said central chamber in a direction lateral to said centerline, said propelling nozzle facilitating discharge of at least a portion of high pressure gas at least partially upwardly from said central chamber and causing a reactive force down on the muzzle end of the barrel of the firearm in a direction opposite an orientation of said propelling nozzle;

wherein said propelling nozzle has tapering sidewalls causing said propelling nozzle to have a lesser cross-sectional area closer to said centerline and a greater cross-sectional area further from said centerline, and with a greatest cross-sectional area at a greatest distance from said centerline, said greatest cross-sectional area greater than the cross-sectional area of all other portions of said propelling nozzle, said side walls tapering less adjacent to said greatest cross-sectional area than at said lesser cross-sectional area;

wherein said propelling nozzle is associated with a slide of a semiautomatic firearm; and wherein said propelling nozzle is machined directly into said slide of said semiautomatic firearm, said firearm in the form of a semiautomatic pistol.

2. A muzzle brake for a barrel of a firearm, comprising in combination:

the muzzle brake structure located at a muzzle end of the barrel;

the muzzle brake structure including a central chamber with a proximal opening and a distal opening, said proximal opening and said distal opening on opposite sides of said central chamber;

said proximal opening and said distal opening each oriented along a centerline co-linear with and extending beyond the muzzle end of the barrel of the firearm;

said proximal opening and said distal opening each sized large enough to allow a bullet discharged from the muzzle end of the barrel to pass through both said proximal opening and through said distal opening;

a propelling nozzle extending at least partially from said central chamber in a direction lateral to said centerline, said propelling nozzle facilitating discharge of at least a portion of high pressure gas at least partially upwardly from said central chamber and causing a reactive force down on the muzzle end of the barrel of the firearm in a direction opposite an orientation of said propelling nozzle;

wherein said propelling nozzle has tapering sidewalls causing said propelling nozzle to have a lesser cross-sectional area closer to said centerline and a greater cross-sectional area further from said centerline, and with a greatest cross-sectional area at a greatest distance from said centerline, said greatest cross-sectional area greater than the cross-sectional area of all other portions of said propelling nozzle, said side walls tapering less adjacent to said greatest cross-sectional area than at said lesser cross-sectional area;

wherein a plurality of propelling nozzles are each provided extending upwardly from said central chamber at differing distances away from said proximal opening.

3. The muzzle brake of claim 2 wherein said plurality of propelling nozzles are spaced from each other along a spiral path spiraling about a centerline of the barrel.

4. The muzzle brake of claim 1 wherein a plurality of propelling nozzles extend laterally from said centerline with at least two said propelling nozzles extending from said centerline in directions which are non-parallel with each other.

5. The muzzle brake of claim 4 wherein at least one of said propelling nozzles extends from said central chamber at least partially rightwardly so that a firearm having a tendency to move to the right during bullet discharge has a counteracting force tending to counteract movement of the muzzle end of the barrel during bullet discharge.

6. The muzzle brake of claim 1 wherein said muzzle brake structure is removably attachable to the firearm adjacent to the muzzle end of the barrel of the firearm.

7. The muzzle brake of claim 1 wherein said muzzle brake is permanently affixed to the muzzle end of the barrel of the firearm.

8. The muzzle brake of claim 1 wherein said distal opening and said propelling nozzle have no structure separating them from each other.

9. The muzzle brake of claim 1 wherein said distal opening and said propelling nozzle have bridge structure therebetween, separating said distal opening from said propelling nozzle.

10. A firearm with a muzzle brake thereon, the firearm comprising in combination:

a firing chamber at a proximal end of a barrel, said barrel extending from said proximal end to a distal end;

said distal end including a muzzle brake thereon, said muzzle brake including a central chamber with a proximal opening and a distal opening, said proximal opening and said distal opening on opposite sides of said central chamber;

said proximal opening and said distal opening each oriented along a centerline colinear with said barrel of said firearm;

said proximal opening and said distal opening each sized large enough to allow a bullet discharged from the barrel to pass through both said proximal opening and through said distal opening;

a propelling nozzle extending at least partially upwardly from said central chamber in a direction lateral to said centerline, said propelling nozzle facilitating discharge of at least a portion of high pressure gas exiting said distal end of said barrel, and causing a reactive force at least partially down on said distal end of said barrel of said firearm in a direction opposite an orientation of said propelling nozzle;

wherein said propelling nozzle has a shape causing upper portions of said nozzle to be larger in cross-sectional area perpendicular to a line that is perpendicular to said centerline than portions of said propelling nozzle below said upper portions;

wherein sidewalls of said propelling nozzle taper outwardly as said propelling nozzle extends upwardly;

wherein said sidewalls taper at least partially semi-spherically as said propelling nozzle extends upwardly; and wherein said sidewalls of said propelling nozzle include both lateral sides which taper and fore and aft sides which taper.

11. The firearm of claim 10 wherein said distal opening and said propelling nozzle extend into each other without structure overlying said distal opening.

12. A firearm with a muzzle brake thereon, the firearm comprising in combination: a firing chamber at a proximal end of a barrel, said barrel extending from said proximal end to a distal end; said distal end including a muzzle brake thereon, said muzzle brake including a central chamber with a proximal opening and a distal opening, said proximal opening and said distal opening on opposite sides of said central chamber; said proximal opening and said distal opening each oriented along a centerline colinear with said barrel of said firearm; said proximal opening and said distal opening each sized large enough to allow a bullet discharged from the barrel to pass through both said proximal opening and through said distal opening; a propelling nozzle extending vertically upwardly from said central chamber in a direction lateral to said centerline, said propelling nozzle facilitating discharge of at least a portion of high pressure gas exiting said distal end of said barrel, and causing a reactive force vertically down on said distal end of said barrel of said firearm in a direction opposite an orientation of said propelling nozzle; wherein said propelling nozzle has a shape causing upper portions of said nozzle to be larger in cross-sectional area perpendicular to a line that is perpendicular to said centerline than portions of said propelling nozzle below said upper portions; wherein sidewalls of said propelling nozzle taper outwardly as said propelling nozzle extends upwardly; wherein said sidewalls taper parabolically as said propelling nozzle extends upwardly; and wherein said sidewalls include lateral sides as well as fore and aft sides.

13. The firearm of claim 10 wherein said distal opening and said propelling nozzle are spaced from each other by a bridge on a distal side of said propelling nozzle and above said distal opening.

14. The firearm of claim 10 wherein said propelling nozzle has a longer horizontal dimension parallel with said centerline then a horizontal dimension perpendicular to said centerline.

15. A firearm with a muzzle brake thereon, the firearm comprising in combination:

a firing chamber at a proximal end of a barrel, said barrel extending from said proximal end to a distal end;

said distal end including a muzzle brake thereon, said muzzle brake including a central chamber with a proximal opening and a distal opening, said proximal opening and said distal opening on opposite sides of said central chamber;

said proximal opening and said distal opening each oriented along a centerline colinear with said barrel of said firearm;

said proximal opening and said distal opening each sized large enough to allow a bullet discharged from the barrel to pass through both said proximal opening and through said distal opening;

a propelling nozzle extending at least partially upwardly from said central chamber in a direction lateral to said centerline, said propelling nozzle facilitating discharge of at least a portion of high pressure gas exiting said distal end of said barrel, and causing a reactive force at least partially down on said distal end of said barrel of said firearm in a direction opposite an orientation of said propelling nozzle;

wherein said propelling nozzle has a shape causing upper portions of said nozzle to be larger in cross-sectional area perpendicular to a line that is perpendicular to said centerline than portions of said propelling nozzle below said upper portions;

wherein sidewalls of said propelling nozzle taper outwardly as said propelling nozzle extends upwardly;

wherein said sidewalls taper at least partially semi-spherically as said propelling nozzle extends upwardly; and wherein said propelling nozzle is one of a plurality of propelling nozzles extending upwardly at least partially from said central chamber.

* * * * *